United States Patent [19]

Brown et al.

[11] 3,989,246

[45] Nov. 2, 1976

[54] TENNIS PRACTICE SYSTEM

[76] Inventors: Alvin I. Brown, 3031 Gates Road NW., Washington, D.C. 20037; Sylvan P. Stein, 6661 Barnaby St. NW., Washington, D.C. 20015; Eugene L. Swensen, 9605 Sunset Drive, Rockville, Md. 20850

[22] Filed: Sept. 20, 1974

[21] Appl. No.: 507,853

Related U.S. Application Data

[63] Continuation-in-part of Ser. No. 424,911, Dec. 14, 1973, abandoned.

[52] U.S. Cl. ..... 273/29 A; 124/51 A; 124/73; 273/102.2 B; 273/102.4

[51] Int. Cl.[2] ..... A63B 61/00

[58] Field of Search ..... 273/29 A, 26 R, 26 A, 273/26 D, 177 R, 179 R, 181 F, 103, 181 H, 181 K, 182 R, 101, 102 R, 127 R, 127 C, 102 R, 102.4; 124/49, 51 A, 11 R, 50 R, 29 A, 51 R

[56] References Cited

UNITED STATES PATENTS

| | | | |
|---|---|---|---|
| 1,282,342 | 10/1918 | Whiteker | 273/103 |
| 2,147,003 | 2/1939 | Kozurik | 124/11 R |
| 2,280,376 | 4/1942 | Clark | 273/29 A |
| 2,508,461 | 5/1950 | Lemon | 273/30 |
| 2,765,171 | 10/1956 | Cook | 273/30 |
| 2,899,208 | 8/1959 | Wallsteiner | 273/182 R |
| 3,009,703 | 11/1961 | Jentsch et al. | 124/11 R X |
| 3,089,476 | 5/1963 | Wolverton | 273/101 X |
| 3,215,432 | 11/1965 | Lee et al. | 273/29 A |
| 3,410,556 | 11/1968 | Kaiser et al. | 273/30 |
| 3,724,438 | 4/1973 | Brandt | 124/11 R |
| 3,761,085 | 9/1973 | Cook | 273/30 |
| 3,766,901 | 10/1973 | Mort, Jr. et al. | 124/48 |

FOREIGN PATENTS OR APPLICATIONS

| | | | |
|---|---|---|---|
| 395,830 | 1/1966 | Switzerland | 273/29 R |
| 10,643 | 5/1902 | United Kingdom | 273/30 |

*Primary Examiner*—Richard C. Pinkham
*Assistant Examiner*—T. Brown
*Attorney, Agent, or Firm*—Berman, Aisenberg & Platt

[57] ABSTRACT

A tennis practice apparatus consisting of an enclosure providing a playing area and having a regulation-height net member at one end located in front of a cage-like structure forming the end of the apparatus. This cage-like structure is arranged to cause a ball passing rearwardly over the net member to drop into the lower portion of the structure, which is concave and which is provided at its lowest point with a conduit connection leading to a pneumatic ball collecting and propelling mechanism having an outlet conduit directed so as to project balls forwardly over the net toward a player. The mechanism has an upper compartment with an inclined ramp element leading to a rotary ball-feeding member operated by a Geneva-type driving system acting to sequentially feed balls into registry with an outlet duct and a valved aperture in a partition wall between said upper compartment and a lower compartment. A blower or similar air compressor device provides positive air pressure in the lower compartment and negative air pressure in the upper compartment. The positive air pressure propels the balls forwardly to the player through the outlet conduit. A photoelectric scoring array is provided in the cage-like structure to record scores in accordance with zonal location of returned balls.

34 Claims, 27 Drawing Figures

A
B
C
D
E
I
II
III
1
2
3
4
7
8
11
11a
11b
30
51
110
129
130
131
132
133
134
135
136
140
141
143

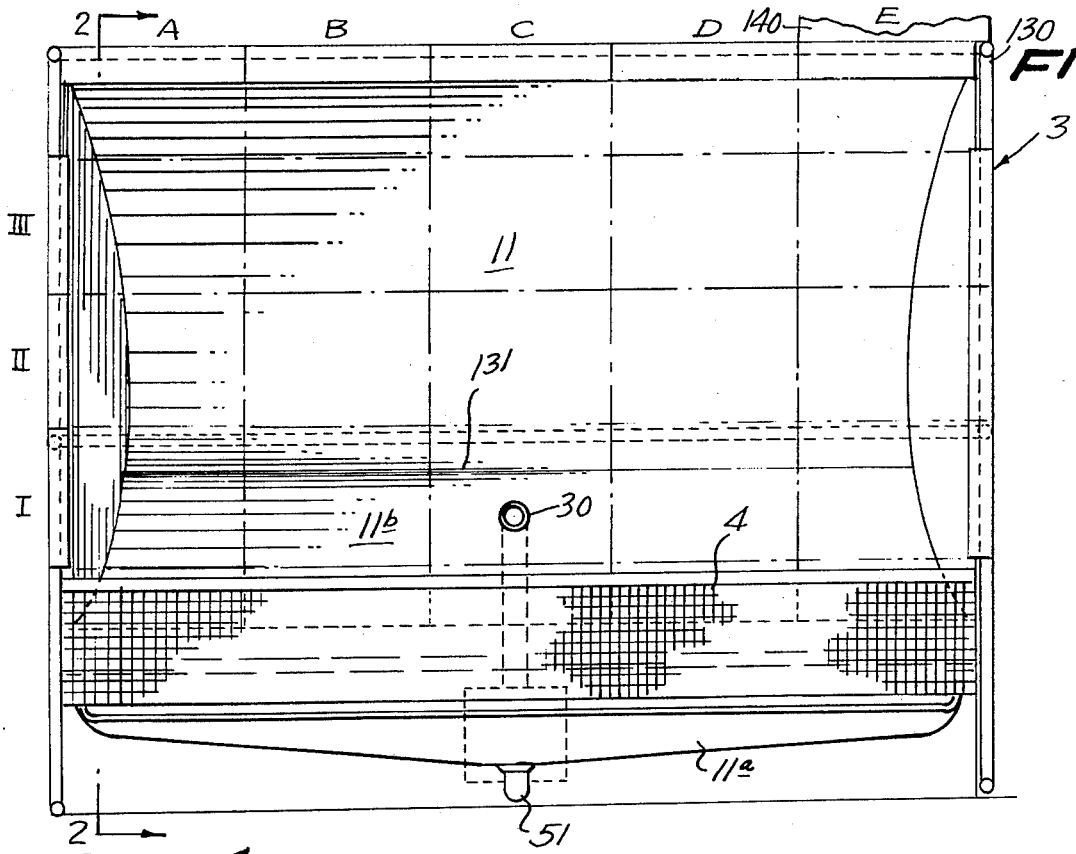
FIG. 3.
FIG. 4.
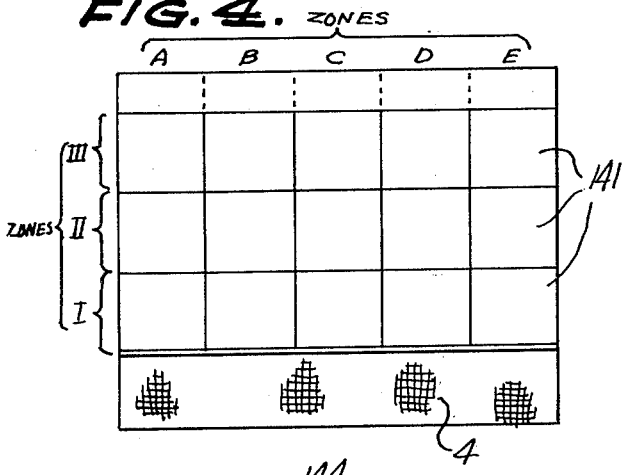
FIG. 6.
140
| | | | | |
|---|---|---|---|---|
| 50 | 75 | 100 | 75 | 50 |
| 75 | 100 | 125 | 100 | 75 |
| 100 | 125 | 150 | 125 | 100 |
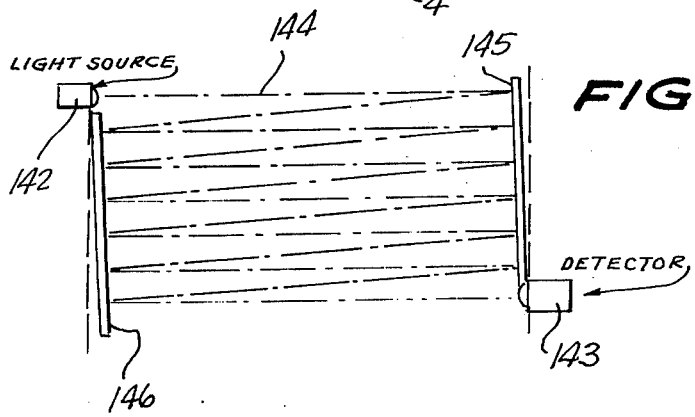
FIG. 5.

8
107
102
30
24
128
56
53
50
55
70
23
126
100
125
127
116
101
109
110
111
26
59
54
112
113
114
63
69
68
108
61
117

276
282
289
284
284
283
251
271
270
272
273'
261
204
274
260
273
262
266
268
230
125
269
275
16
20
282
279
276
20
22
283
284
251
22
277
278
16
208
262
265
263
266
267

FIG. 18.
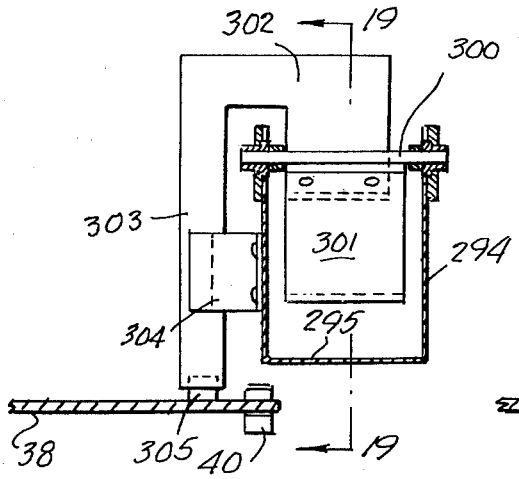
FIG. 19.
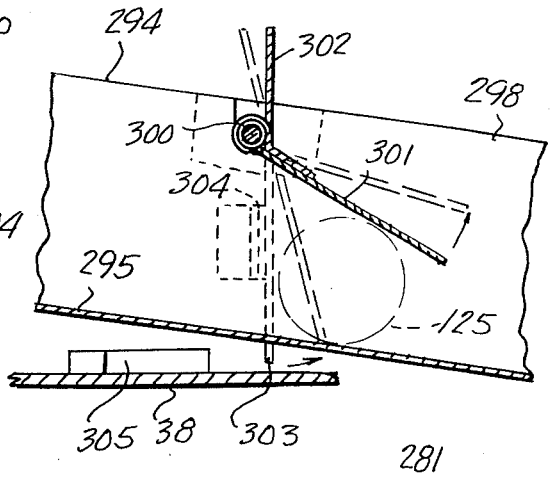
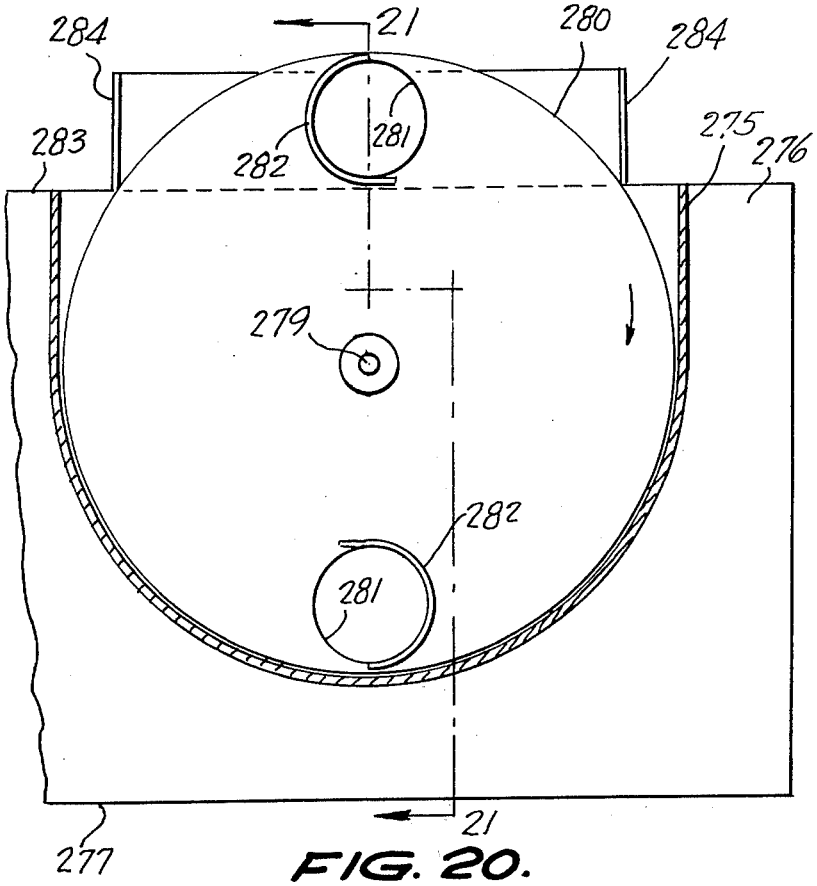
FIG. 20.
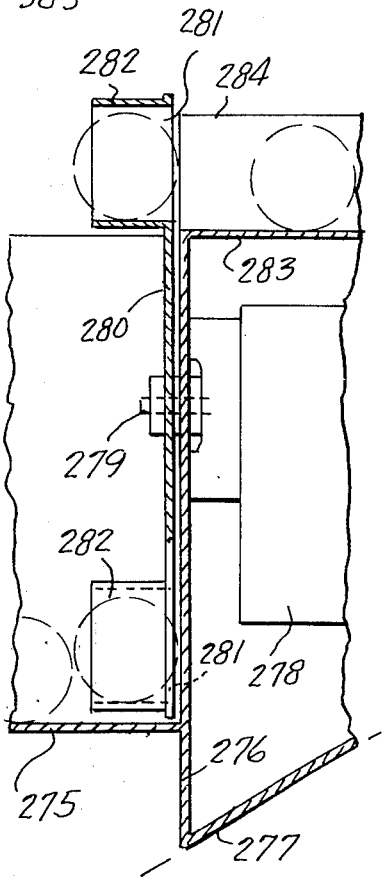
FIG. 21.

TENNIS PRACTICE SYSTEM

This application is a continuation-in-part of our previously filed application, Ser. No. 424,911, filed Dec. 14, 1973, (now abandoned) and entitled "TENNIS PRACTICE SYSTEM".

BACKGROUND OF THE INVENTION

This invention relates to tennis practice apparatus and more particularly to a tennis practice system enabling a single player to practice under conditions closely simulating those of an actual tennis court.

Tennis practice has heretofore required the use of an actual tennis court with an instructor or other person to return balls over the net to the practicing player. There is, therefore, a need for a system which in a relatively small playing area, mechanically provides the conditions whereby a single player can practice without the cooperation of another player and without the necessity of using a regulation-size court. Also, there is a need for such a practice device where balls can be repeatedly served to a player at a rate and velocity which can be adjusted in accordance with the needs and ability of the player, and wherein an accurate scoring means can be provided to measure the accuracy with which the player returns the served balls over the net. There is a need for such a tennis practice apparatus which can be employed either indoors or outdoors, which can be made portable, if so desired, and which can be designed for coin-controlled operation.

SUMMARY

A main object of the invention is to provide a novel and improved tennis practice apparatus which provides substantially standard playing conditions, which can be employed by a single player, which is smaller in size than an actual tennis court, and which is arranged to repeatedly serve balls to a player at a desired rate and velocity.

A further object of the invention is to provide an improved tennis practice apparatus of relatively compact size and comprising relatively simple components which enables a single player to practice under substantially standard court conditions and wherein balls are repeatedly served to the player at an adjusted rate and velocity to enable the player to return the balls over a net and to provide scoring indications of the accuracy of the returns, and wherein the returned balls are automatically collected and re-fed into the system so that a practice session may be continued by a player for any desired period of time.

A still further object of the invention is to provide an improved tennis practice apparatus suited for a single player, the apparatus being adjustable to the skill of the player, providing reliable scoring indications of the accuracy of the return of balls by the player, eliminating loss of time in returning balls, enabling a player to concentrate on returning served balls, enabling a player to practice at a rate commensurate with his skill and stamina, being useful as an instructional aid by enabling a teacher to closely observe a player being instructed without the necessity of the teacher serving balls to the player and collecting the balls, and being readily adaptable to coin-controlled operation so that it can be employed successfully on a commercial basis.

A still further object of the invention is to provide a new and improved tennis practice apparatus including (a) a ball throwing device, (b) a ball collection system, (c) an energy-absorbing screen system, and (d) a scoring system, incorporated into a single practical unit which is highly reliable and which is of an overall size which will allow the installation of a plurality of such units (as many as six or eight) within the space required for a regulation doubles court.

A still further object of the invention is to provide a tennis practice system suitable for control by coin-actuated timer means of a type providing a player with a defined length of play time per coin deposited.

A still further object of the invention is to provide a system arrangement which will allow a court owner to substantially increase the available income of a given practice area over that which could be achieved by court rental for normal play.

A still further object of the invention is to provide a tennis practice system which can be operated without attendants, yielding minimal operating cost, the system containing relatively simple mechanisms which can operate continuously over long periods of time without malfunction, thereby minimizing loss of income from system interruptions.

A still further object of the invention is to provide an improved mechanical tennis practice unit which will function satisfactorily with a minimum number (for example, twelve) of practice balls within the system (in contrast to prior systems requiring as many as fifty to one hundred balls, which must be reloaded at intervals to maintain play).

Further objects and advantages of the invention will become apparent from the following description and claims, and from the accompanying drawings.

BRIEF DESCRIPTION OF THE DRAWINGS

FIG. 3 is a transverse vertical cross-sectional view taken substantially on line of FIG. 2.

FIG. 4 is a diagrammatic view showing the various scoring zones in relation to the net of the tennis practice unit of FIG. 1.

FIG. 5 is a diagram showing the optical beam path in one of the scoring zones.

FIG. 6 is a scoreboard typically showing the scores for the respective scoring zones.

FIG. 18 is a vertical cross-sectional view taken substantially on line 18—18 of FIG. 16.

FIG. 19 is a cross-sectional view taken substantially on line 19—19 of FIG. 18.

FIG. 20 is an enlarged cross-sectional view taken substantially on line 20—20 of FIG. 15.

FIG. 21 is a vertical cross-sectional view taken substantially on line 21—21 of FIG. 20.

DESCRIPTION OF A PREFERRED EMBODIMENT

Figures 1, 2:
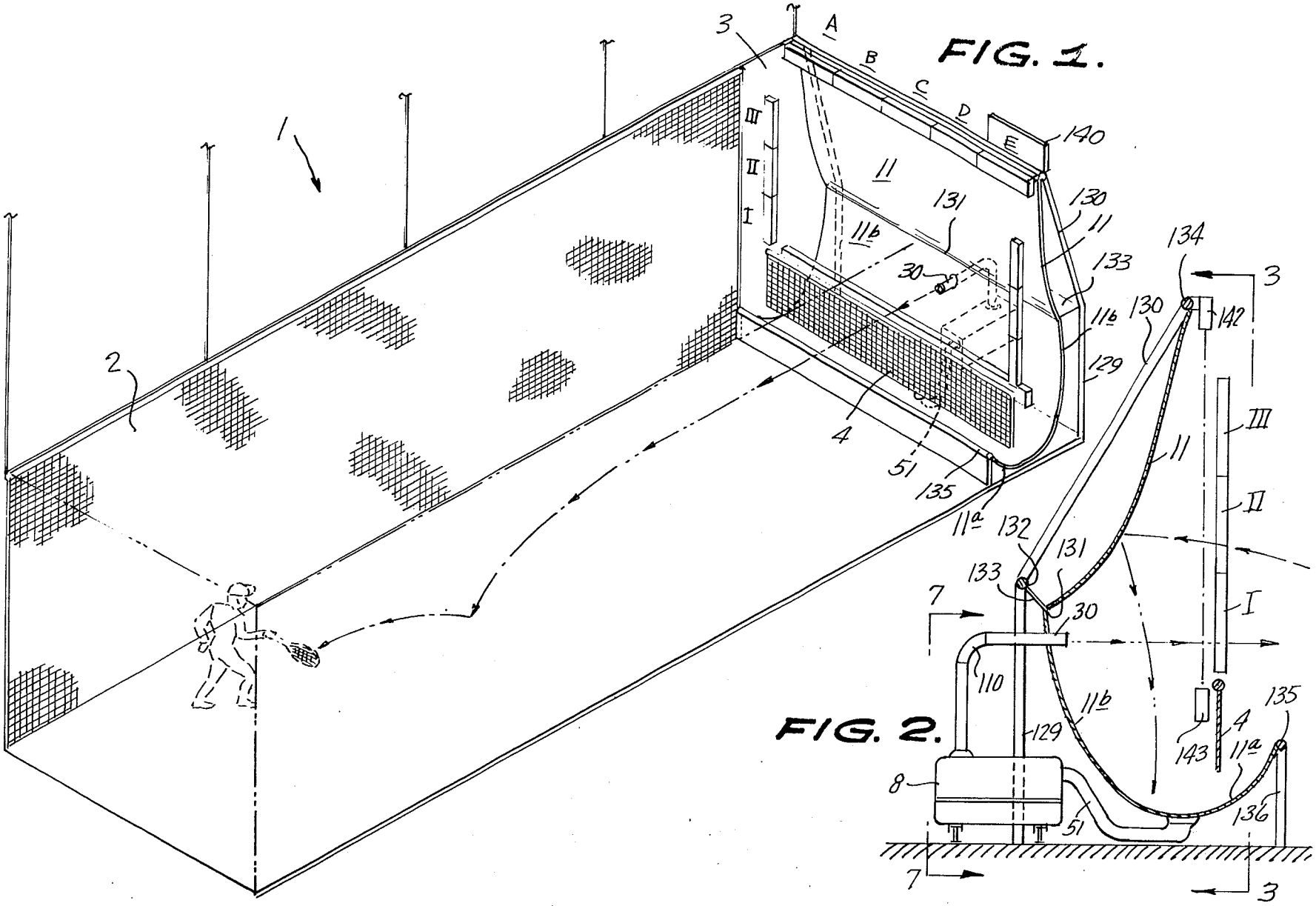
FIG. 1 is a perspective view of a typical tennis practice unit according to the present invention, with some of the enclosure wall elements removed to show structural features.
FIG. 2 is a vertical longitudinal cross-sectional view taken through the cage portion of the practice unit of FIG. 1, said view being taken substantially on line 2—2 of FIG. 3.
Figure 8:
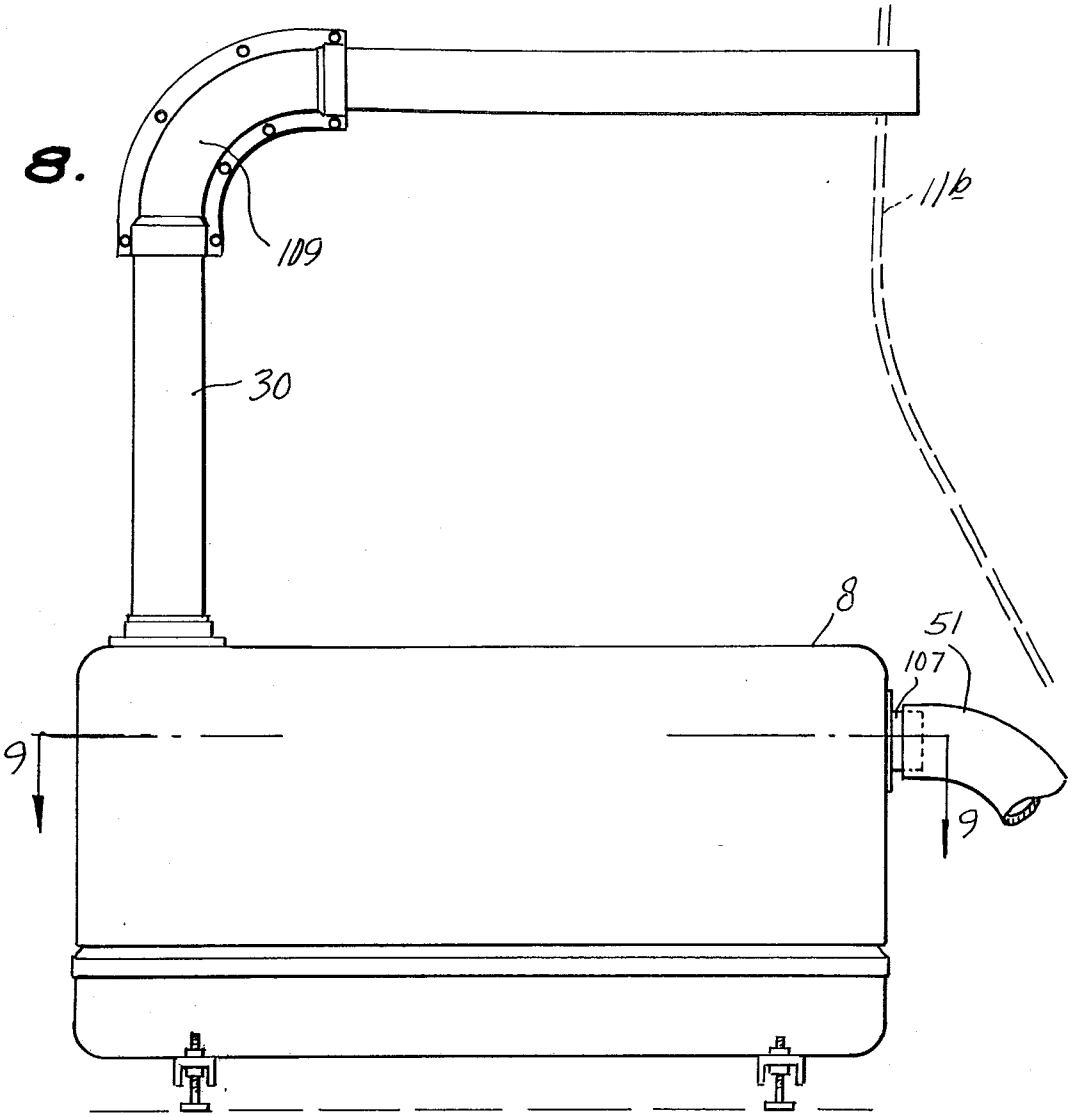
FIG. 8 is an elevational view taken substantially on line 8—8 of FIG. 7.
Figure 7:
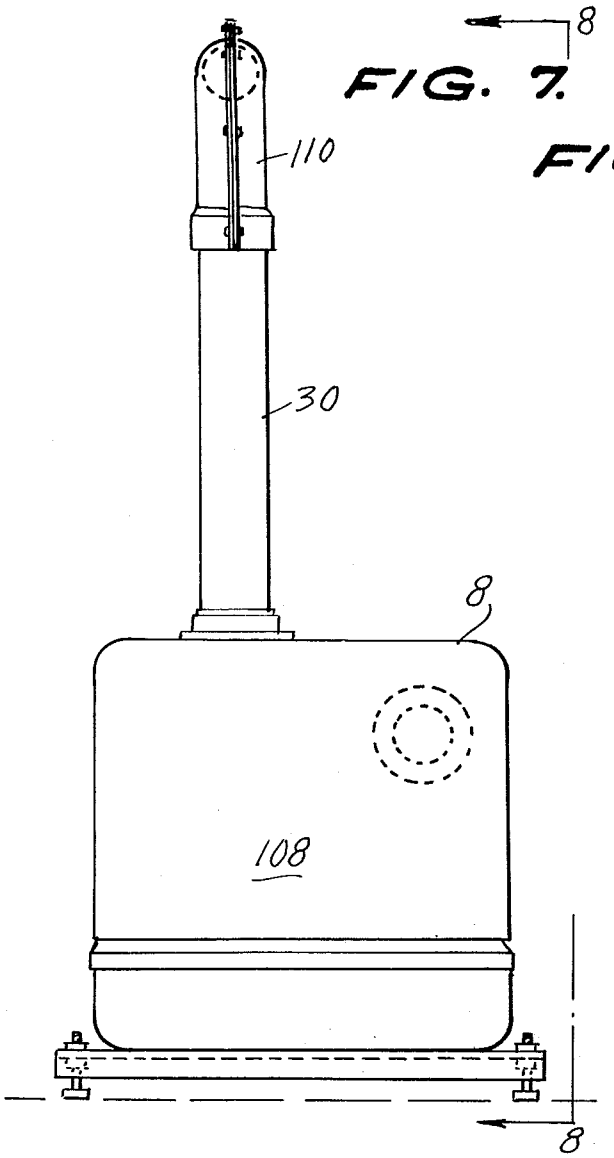
FIG. 7 is an enlarged elevational view taken substantially on line 7—7 of FIG. 2 and showing the ball collecting and propulsion portion of the assembly.

In a preferred embodiment of the present invention, the following primary concept is utilized:

A practice court is employed which may be approximately 15 feet wide and 45 feet deep, with the collection enclosure, throw-and-collect mechanism, and regulation-height net element at one end. The practicing player will stand approximately 40 feet from the net element. The throwing mechanism will fire balls, just over the net element, which will impact on the court surface at a distance of approximately 30 feet from the net element in a trajectory which will allow the balls to bounce to waist-height at the player's position. The speed of the balls and the frequency of firing will be adjustable but will be normally at the speed of a normal average return and will be at approximately six-second intervals. After the balls bounce, the practicing player will return the balls to the collection enclosure and collection system with either a forehand or backhand stroke. Return of the balls to various positions of the screened back portion of the collection enclosure will register scores appropriate to the area of the screen hit. The energy of a ball hitting the screen will be absorbed by a special structural arrangement of the screen which will allow the ball to drop (with minimal bounce) into the lower portion of the collection enclosure where it will roll by gravity to the collection point. The machine will then collect and return the ball to the throwing mechanism for a subsequent shot.

Referring to the drawings, a typical practice unit according to the present invention is designated generally at 1. The unit has suitable walls 2, of netting or mesh material, or of any other suitable material, defining the practice enclosure, and is provided at one end with a cage portion 3, including a regulation-height net 4 and pneumatic device, shown generally at 8, which will collect balls with negative pressure through an intake conduit 51 and eject them over net 4 with positive pressure through an ejection conduit 30 at adjustable time intervals.

The device 8 may be suitably encased in weatherproof material for outdoor or indoor use.

As shown, the pneumatic device 8 may comprise a generally rectangular housing divided into two compartments by a horizontal partition wall 23, which may be referred to as a pressure deck. Horizontal wall 23 thus defines an upper compartment 100 which is a ball collection space, and which will normally be at a slightly negative pressure, and a lower compartment 101, which is a ball propulsion space and which will normally be at a positive pressure.

The pneumatic pressure source comprises a motor-driven peripheral type blower 50 mounted on deck 23 which has an inlet port 53 communicating the upper space 100 and an outlet conduit 52 communicatively connected to space 101. While other types of blowers or compressors may be employed, such as belt-driven multi-stage fans, direct-driven multi-stage fans driven by a high speed electric motor, a compressor of the vane or diaphragm type, or the like, the use of a direct-driven peripheral type blower is preferred, since it defines a source of adequate pressure and suction and yet can be driven at a speed low enough to allow the use of a conventional AC driving motor. The other above-mentioned alternates require the use of various elements which are subject to relatively rapid wear, such as commutator brushes, belts, vanes, diaphragms and the like, requiring a relatively high degree of maintenance.

Figure 9:
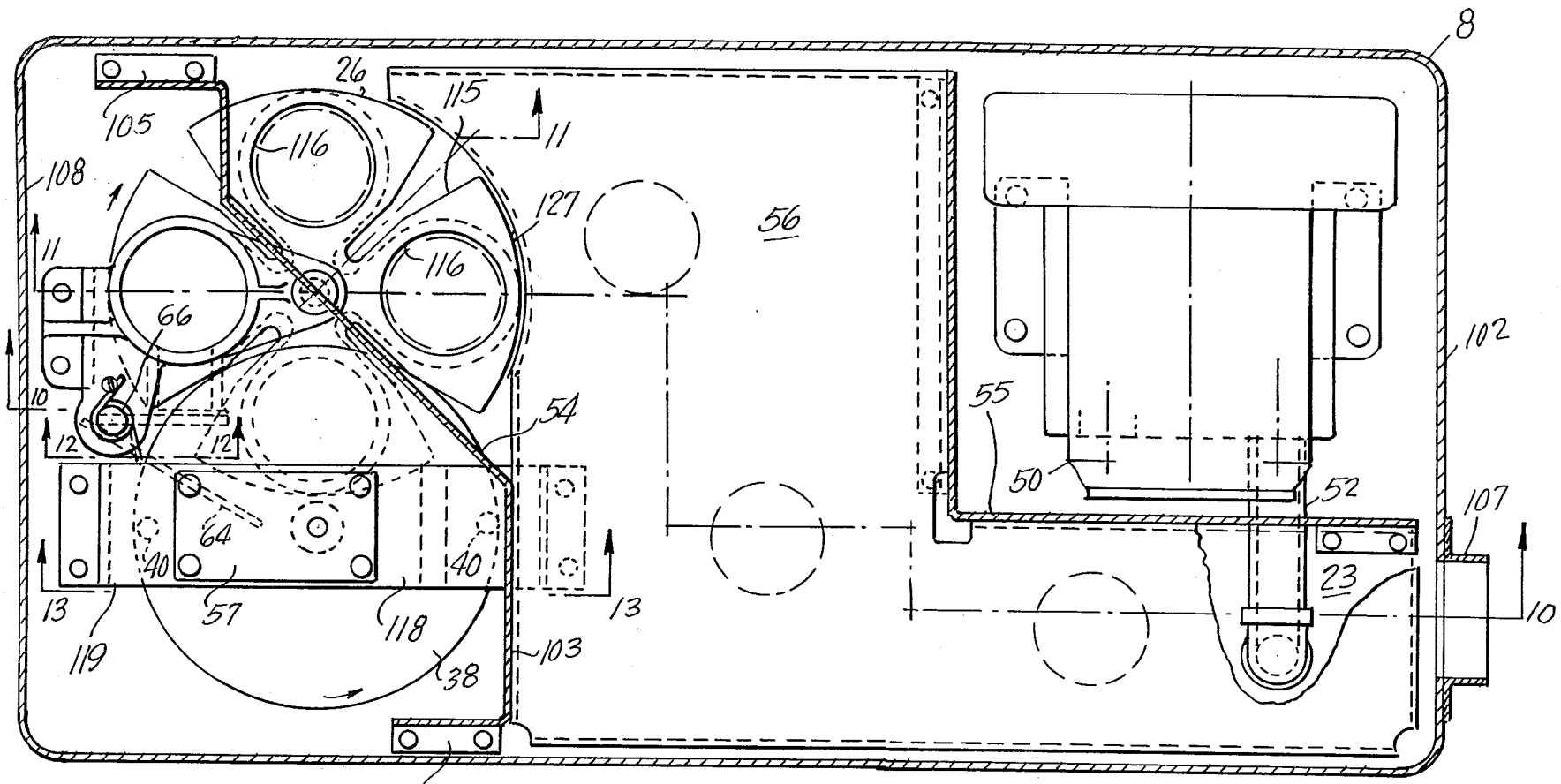
FIG. 9 is an enlarged horizontal cross-sectional view taken substantially on line 9—9 of FIG. 8.
Figure 10:
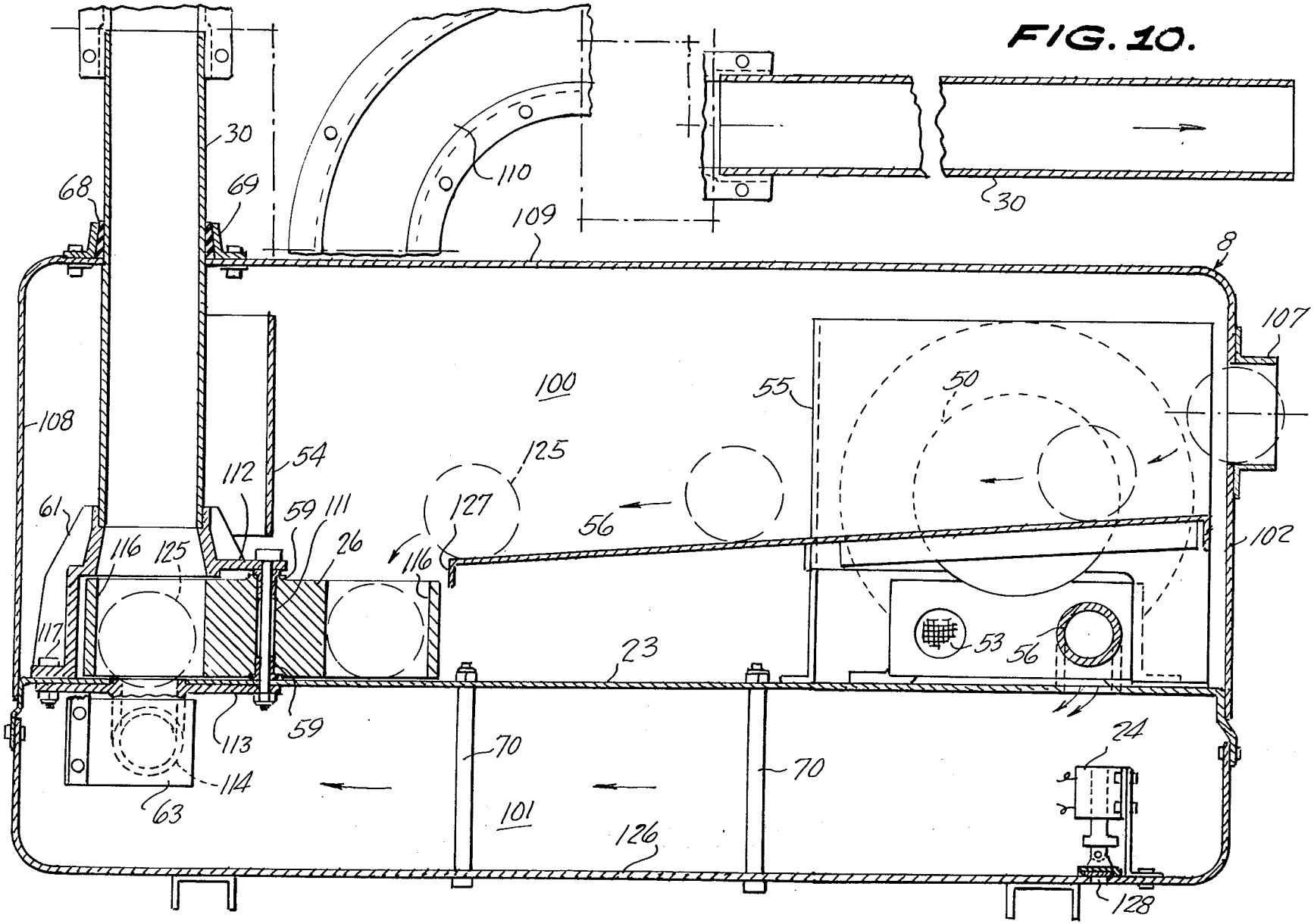
FIG. 10 is a longitudinal vertical cross-sectional view taken substantially on line 10—10 of FIG. 9.

As shown in FIGS. 2 and 10, the ball collection conduit 51 is connected to the upper portion of the front end wall 102 of the device 8. An inclined ramp member 56 is mounted in the upper space 100 below the connection of conduit 51 and is inclined downwardly and rearwardly therefrom toward the diagonally-directed portion 54 of a vertical partition wall 103 secured by end flanges 104, 105 to deck 23. As shown in FIGS. 9 and 10, the blower assembly 50 is contained in an enclosure defined by upstanding wall elements 55, 55 bent at right angles to each other and secured to deck 23.

As shown in FIG. 9, the front wall 102 of the device 8 is provided with a suitable outlet fitting 107 to which the flexible ball inlet conduit 51 is connected. Adjacent the opposite end wall of the device 8, shown at 108, an outlet fitting 61 is secured on deck 23, and ball outlet conduit 30 is connected to this fitting in the manner shown in FIG. 10. Thus, the rigid outlet conduit 30 extends vertically through the top wall of device 8, shown at 109, being sealingly received through an annular fitting 69 provided with a resilient deformable sealing ring 68 wedgingly engaged between conduit 30 and member 69.

As shown in FIG. 2, the conduit member 30 has a right angled elbow bend portion at 110, whereby the outlet end portion of the conduit is substantially horizontal and is directed forwardly extending through the lower portion 11b of an energy-absorbing assembly, presently to be described, the horizontal outlet portion of conduit 30 being located at a level slightly above the top edge of the practice net 4.

Figure 11:
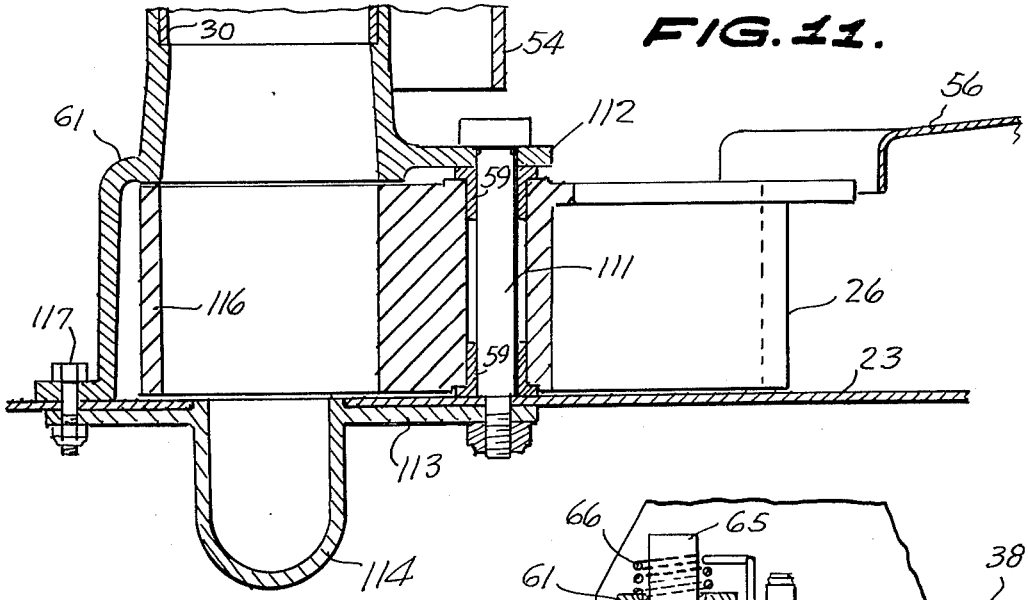
FIG. 11 is an enlarged vertical cross-sectional detailed view taken substantially on line 11—11 of FIG. 9.

The fitting 61 is suitably recessed to receive thereunder a sector portion of a horizontally disposed rotary ball member 26 which is journalled to a vertical pivot bolt 111. Pivot bolt 111 extends through a horizontal flange 112 integrally formed with bracket 61, through the horizontal deck 23 and through a flange 113 of a conduit fitting 114 presently to be described. The turret member 26 comprises a main body formed with four equally spaced vertical ball-conducting conduits 116 carried by a top circular plate formed with the corresponding four equally spaced, substantially radially extending, outwardly flaring cam slots 115. The member 26 is journalled to rotate freely relative to the conduit fitting 61 by the provision of suitable flanged top and bottom bearing bushings 59, 59 between fixed bolt member 111 and the vertical central bore of the member 26, as shown in FIG. 11. As is further clearly shown in FIG. 11, the member 26 is so journalled that the vertical conduit 116 are sequentially registrable with the outlet conduit fitting 61. The bottom conduit fitting 114 is generally elbow-shaped, and its vertical duct portion extends through an aperture provided in deck 23 and is substantially aligned with the outlet conduit fitting 61, so that the ball conveying conduit members 116 of the turret 26 are sequentially registrable simultaneously with the bottom conduit fitting 114 and the outlet conduit fitting 61 in the manner illustrated in FIG. 11.

Further clamping bolts 117 may be employed to secure conduit fitting 61 and conduit fitting 114 to the top and bottom surfaces of deck 23 in the manner illustrated in FIG. 11.

Figure 13:
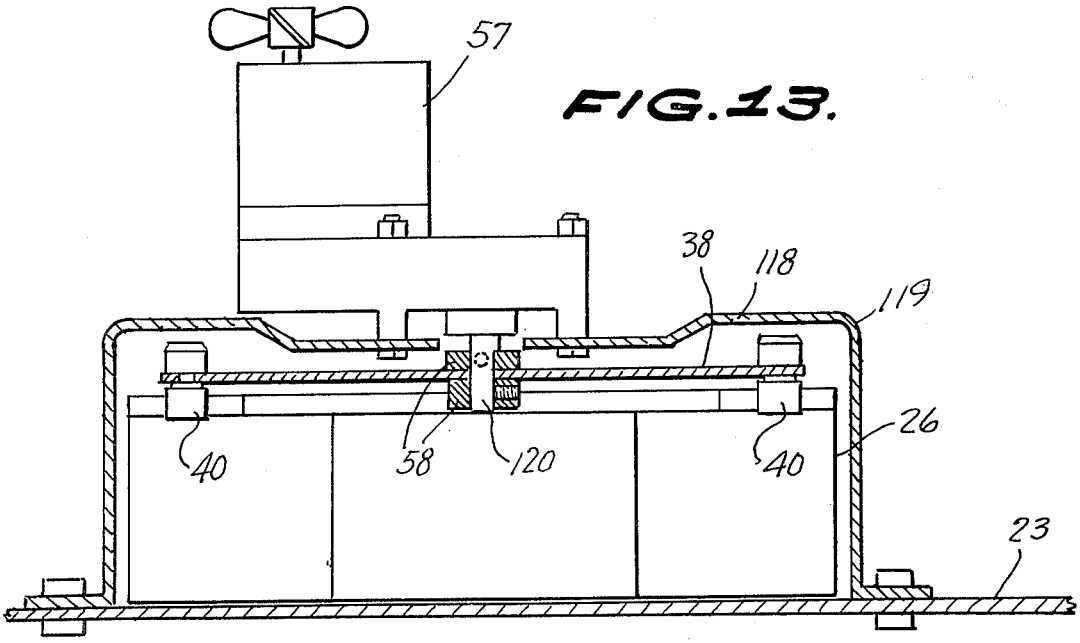
FIG. 13 is an enlarged vertical cross-sectional view taken substantially on line 13—13 of FIG. 9.

As above-mentioned, the member 26 is provided with a generally circular top flange portion formed with the equally spaced radial cam slots 115 which are located between adjacent ball-conveying conduit portions 116. Designated at 38 is a horizontally arranged circular cam disk which is journalled to the top arm 118 of an inverted U-shaped bracket 119 secured to deck 23 in the manner shown in FIG. 13, the circular cam plate 38 being drivingly connected to the output shaft of a small adjustable-speed electric motor 57 suitably mounted on the bracket top arm 118. The motor 57 may be provided with suitable reduction gearing, and the output shaft of the assembly including motor 57 and said reduction gearing is designated at 120. Disk 38 is suitably keyed to shaft 120 for rotation therewith and is held in place on the shaft by the provision of top and bottom retaining collars 58, 58. The horizontal plane of cam disk 38 is located slightly above the horizontal plane of the slots 115, and the cam disk is provided with diametrically opposite camming rollers 40, 40 located to sequentially interengage with the slots 115 to provide a Geneva-type intermittent rotary driving action which drives member 26 intermittently through a quarter turn each time a roller 40 interengages with a slot 115 and allows a dwell period during which a ball carried in the conduit portion 116 aligned with conduit elements 61 and 114 may be expelled from the device 8.

Figure 12:
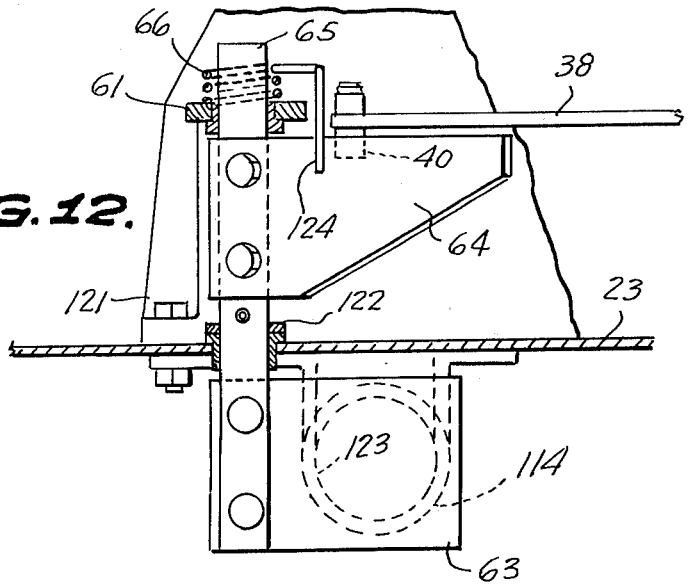
FIG. 12 is an enlarged vertical cross-sectional view taken substantially on line 12—12 of FIG. 9.

During the dwell period after one of the driving rollers 40 disengages from a slot 115, the driving roller 40 drivingly engages an actuating arm 64 secured on the upper portion of a vertical shaft member 65 journalled in an upstanding bracket member 121 forming part of conduit element 61, as shown in FIG. 12. Shaft member 65 extends through a bearing bushing 122 mounted in deck member 23, and secured to the lower end of the shaft 65 adjacent the conduit fitting element 114 is a vertical flap member 63. Conduit member 114 has a vertical rim portion 123, and the flap member 63 is preferably provided with a suitable resiliently deformable lining which is sealingly engagable with rim 123. Flap valve member 63 is biased toward sealing engagement with rim 123 by the provision of a biasing torsion spring 66 on the top end of shaft 65, the spring having one end thereof anchored to the top flange 61 of bracket 121 and having its other end, shown at 124 depending and drivingly engaging arm 64 to bias the shaft in the direction urging flap valve element 63 into sealing engagement with rim 123. The engagement of a roller 40 with the arm 64 rotates shaft 65 in a direction to uncover rim 123 allowing air under pressure to enter conduit 114 and to act on a tennis ball, shown at 125, located in the conduit portion 116 in registry with conduit 30 and conduit 114, in the manner shown in FIG. 10. The exposure of conduit 114 to the positive pressure in the lower space 101 occurs in the dwell period of member 26, providing the required propulsion of the tennis ball 125 through the outlet conduit 30. As the roller 40 disengages from the arm 64, the valve element 63 quickly moves back to closing position, allowing recovery of pressure in the space 101 to a sufficient value to enable the next ball to be ejected from the device 8 through the outlet conduit 30 as cam disk 38 continuously rotates.

As shown in FIG. 10, a plurality of suitably spaced spacer posts 70 may be provided between deck 23 and the bottom wall of device 8, shown at 126, to hold deck 23 against deflection because of the pressure differential existing on opposite sides thereof. Also, as shown in FIG. 10, a solenoid-operated vent valve 24 is provided which may be operated, as required, to expose a vent aperture 128 in bottom wall 126 in a manner to provide a suitably reduced pressure value in the space 101, for example, where it is desired to reduce the speed of ejection of a tennis ball through the outlet conduit 30. The solenoid valve 24 may be operated by a suitable control means, to provide a sufficient amount of opening of the vent 128 to reduce the average pressure in space 101 to the desired value.

As will be apparent from FIGS. 9 and 10, balls entering the device 8 through the entrance fitting 107 will roll down the inclined ramp member 56 and will be directed thereby, because of its inclined configuration, toward the arcuate terminal edge portion of the ramp 56, shown at 127, rightwardly adjacent to the path of movement of the ball-receiving receptacles 116 of the rotary member 26. Balls 125 falling into said receptacles will be moved thereby in an intermittent manner, as above described, being eventually brought into registry between conduits 30 and 114. As above-explained, when a ball 125 moves into this position, the flap member 63 is opened, admitting compressed air into the conduit 114 and propelling the ball out of the device 8 through the conduit 30.

As the shown in FIG. 9, the diagonally extending wall element 54 is arranged substantially diametrically relative to the rotary turret member 26, whereby at least two ball-receptacle members 116 are exposed adjacent the ramp member 56 for receiving balls therefrom. Ordinarily, a ball with first fall into the receptacle 116 most closely adjacent to the conformably shaped arcuate edge portion 127 of ramp 56 and will then be carried with the member 26 in a clockwise direction, as viewed in FIG. 9. The rate of movement of the balls by the turret member 26 will be determined by the speed of the driving motor 57, which is preferably adjustable so that the feed rate of the device 8 may be adjusted as desired.

As above-mentioned, the pressure in the space 101 may be controlled by operating the solenoid vent valve 24 to provide a desired average pressure in space 101. This provides a means of controlling the speed of balls ejected from the conduit 30.

As viewed in FIG. 9, the driving disk 38 moves in a counterclockwise direction, and a roller 40 is engagable in a cam slot 115 located beneath diagonally extending wall element 54. Continued counterclockwise rotation of disk 38 then rotates member 26 in a clockwise direction through a quarter revolution bringing a ball contained in a receptacle 116 into a position of registry with conduit 30 and 114, as above described. The roller 40 then starts to leave the cam slot 115, the member 26 remaining stationary at this stage, the roller then engaging the arm 64 and unsealing conduit 114 so as to allow pressurized air to enter therein and act on the ball 125 to propel the ball upwardly through conduit 30. The roller 40 then disengages from the arm 64, releasing the flap member 63 and resealing conduit 114. The diametrically opposite roller 40 will then provide the same action but during the time required for the disk member 38 to rotate through one-half of a revolution, the chamber 101 is enabled to recover pressure.

Referring now to FIGS. 1 and 2, it will be seen that the cage portion 3 has a vertical upstanding end wall portion which may comprise a framework designated at 129 which merges with an upwardly and forwardly inclined upper framework portion 130. Supported by the composite framework including the portions 129 and 130 is an energy-absorbing, suitably draped flexible member which is supported at its intermediate portion to define a horizontal fold 131, located adjacent to and suitably secured to the joint 132 between the vertical lower framework portion 129 and the inclined upper framework portion 130. The connection of the fold 131 to the joint 132 may be made in any suitable manner, for example, by employing a flexible connection panel 133. The fold 131 is so located and arranged as to devine a forwardly convex upper draped portion 11 which is inclined downwardly from the horizontal top member 134 of upper framework portion 130 toward the fold 131, namely, downwardly and to the left, as viewed in FIG. 2, the inclined convex portion 11 overlying the space behind the net 4, as clearly shown in FIG. 2, whereby to cause a ball impinging thereon to drop downwardly behind the net. The lower draped portion 11b below the fold line 131 is upwardly concave and the front end is suitably secured to the top bar 135 of an upstanding rigid frame 136 located forwardly of the net 4, namely to the right thereof as viewed in FIG. 2. The ball intake conduit 51 is connected to the lowermost portion of the upwardly concave member **11*b*, so that balls falling into said upwardly concave portion will roll by gravity into the conduit 51.**

The energy-absorbing members 11 and **11*b*** may be made of suitable loose fabric or other relatively soft material.

From FIG. 2 it will be readily seen that the fold line 131 is located at a level a short distance above the level of the top of net 4, so that most of the balls passing over the net will impinge upon the forwardly convex energy-absorbing upper portion 11 and will drop downwardly into the upwardly concave lower portion **11*b* in t he manner diagrammatically illustrated in FIG. 2.**

As will be clearly apparent from FIG. 2, the upwardly concave lower portion of the energy-absorbing back curtain in the cage portion 3 has a forward portion **11*a* which extends beneath the net 4 and terminates forwardly adjacent the net, being secured to the top bar element 135 of the upstanding frame structure 136. Thus, the forward portion 11*a* serves as a means for catching balls which strike the net 4 and drop therebeneath. As will be seen from FIG. 2, such balls, as well as the balls passing over the net will roll toward the mouth of the collection conduit 51 and will be drawn into said conduit by the negative pressure existing in the upper space 100 of the device 8.**

The practice device 1 includes a suitable optical-electronic, non-contact means of detecting where a returned ball has passed over the net and providing totalized numerical scoring indications for hits in the various zones above the net within the cage area defined thereabove in cage portion 3. A suitable scoring arrangement which may be employed in the apparatus 1 may comprise a conveniently located scoreboard 140 divided into three horizontal rows each comprising five scoring spaces, as shown in FIG. 6, corresponding to the three horizontal rows of scoring spaces 141 shown in FIG. 4 located above the net 4. The vertical columns containing the scoring zones 141 are designated from A to E in FIG. 4, whereas the horizontal rows are designated respectively by the Roman numerals I, II and III in FIG. 4. Appropriate scoring values may be provided for each of the zones 141 thus defined, for example, the numerical scoring values indicated on the scoreboard 140 in FIG. 6. In a typical fifteen foot wide practice court with a fifteen foot high back-stop collection screen area above net 4, each zone 141 would comprise a square three feet wide and three feet high. To optically sense balls passing through the zones thus defined, five vertical optical sensing arrays are provided and three horizontally arranged optical sensing areas are likewise provided, the vertical sensing arrays each covering a three-foot width and the horizontal sensing arrays each covering a three-foot height. Thus, the vertical sensing arrays cover the full width of the fifteen-foot practice court, and the horizontal sensing arrays cover a nine-foot height located above the net 4.

The vertical zones A to E each is provided with a conventional optical system including a suitable light source and a photo-sensitive detector with suitable mirror means to provide a folded optical path through the associated zone with the elements of the path located sufficiently close together to be interrupted by the passage of a ball through the zone, whereby to provide an interruption of the beam. The horizontal zones I, II and III comprise similar optical systems, for example, such as is diagrammatically illustrated in FIG. 5, wherein the light source for the zone is shown at 142 and the photo-sensitive detector is shown at 143. The light source 142 may be provided with suitable collimating means such as lenses or the like, to provide a collimated beam 144 which is folded, namely, reflected by suitably inclined opposite mirrors 145 and 146 to cause the beam 144 to sweep across the entire zone area and finally impinge upon the detector 143. The paths are closely spaced sufficient to be interrupted by the passage of a ball between the opposite reflecting mirrors 145, 146. FIG. 5 illustrates an arrangement for a horizontal zone, but it will be understood that a substantially similar arrangement is likewise provided for each vertical zone, A to E. A suitable response circuit is provided for each photo-sensitive detector 143. Conventional circuitry is provided to energize the appropriate scoring indicator corresponding to the passage of a ball through the intersection of a particular vertical and horizontal zone containing the zone in which the ball passes. It will be noted that the horizontal optical systems I, II and III are located in a vertical plane which is forwardly offset from the vertical plane containing the vertical zones A to E. Thus, a ball passing over the net hit by a player will first pass through the vertical plane containing the horizontal zones I, II and III and then pass through the plane containing the vertical zones A to E. On the other hand, a ball expelled from the firing conduit 30 will first pass through the rearwardly spaced vertical plane containing the vertical zones A to E and will then pass through the vertical plane containing the horizontal zones I, II and III. Conventional sequence-responsive relay circuits are provided to prevent scoring indications by a ball traveling forwardly from the conduit 30.

The sequence-responsive circuitry may be of any suitable type, but will operate to close the scoring circuit only when a detector 143 for the horizontal zones I, II and III has its beam interrupted before a detector 143 for the vertical zone responds to the interruption of its associated light beam. Thus, scoring indications on the scoreboard 140 will be obtained only by balls driven over the net by a player passing through one of the scoring zones.

The numerical score values assigned to each zone are of course arbitrary, but in a typical embodiment of the invention such as that illustrated herein, the scoring values for the horizontal zone I immediately above the net are higher than the upper scoring zones, and likewise, the vertical scoring zones at center court have higher scoring values than the side scoring zones.

The scoring circuits preferably include conventional counters to provide accumulative totals, thereby enabling a player to easily evaluate his proficiency in returning balls and the accuracy of his returned balls at the end of a given practice session.

If so desired, conventional coin-controlled timing circuitry may be provided to control the energization of the operating motors of the device 1, thereby limiting a player's use of the practice device for a time period corresponding to the value of a coin dropped into the coin-controlled mechanism.

In a typical embodiment of the invention, the apparatus is designed to deliver balls at speeds ranging from thirty miles per hour to sixty miles per hour (44 to eight–eight feet per second) requiring pressures of up to 40 inches of water to overcome friction and to obtain the necessary acceleration with moderate lengths of the barrel portion 30. The apparatus above described provides a design which minimizes the air flow required from the blower 50, because the apparatus allows the blower unit to build up pressure in the lower space 101 at intervals between firings, and then release the stored energy suddenly after a ball has been moved into firing position, namely, a position in alignment with conduits 114 and 30. If so desired, suitable yieldable detent means may be provided to hold the turret member 26 in this position. While the firing rate is adjustable, as above-described, by adjusting the speed of the motor 57, a typical or moderate firing rate of about one shot every five seconds would be most frequently employed. With such a cycle, the barrel conduit 30 would be connected with the pressure compartment 101 for approximately one second, or twenty percent of the cycle and the remaining four seconds, or eighty percent of the cycle would be utilized for recharging the pressure compartment 101. With such an arrangement, the blower capacity needs only to be large enough to charge the pressure compartment 101 to the desired pressure in approximately eighty percent of the shortest selectable time cycle, and in a typical design, this would represent a blower capacity providing an average flow rate of approximately 25 cubic feet per minute. The stored energy of compressed air within the pressure compartment 101, when released to the ball-containing barrel conduit 30, will follow natural gas expansion laws and will expel the ball and will flow at a rate corresponding to the necessary increasing velocity of the ball, which is at the same time accelerating at a rate defined by the available pressure. It can be shown that the system pressure will decrease moderately from the initial pressure as the ball progresses through the barrel. This pressure decrease is offset to some degree by the fact that the blower is constantly running and adding pressurized air to the compartment 101 at the same time. It can also be shown that the flow rate of air from the above-described typical system will reach a rate of approximately one hundred eighty cubic feet per minute (at the maximum ball velocity mentioned above of 60 miles per hour) even though the blower itself has only an average flow rate of 25 cubic feet per minute.

As above-mentioned, the inlet port 53 of the blower assembly 50 communicates with the upper compartment 100 and acts to maintain negative pressure therein. Inlet port 53 is preferably protected by a suitable conventional filter-type screen. The negative pressure provided in the compartment 100 is sufficient to effectively draw returning balls into the device 8 through the conduit 51 in the manner above described, preparatory to refiring. As the balls enter the device 8, they will bounce off the bulkhead wall element 55 and 103 and will roll down the ramp wall 56 and will enter the turret 26 by falling into one of the receptacle elements 116, as above-described. As above-mentioned, the turret member 26 may be provided with suitable yieldable detent means to lock it in any one of its four positions to prevent rotation of turret member 26 except when a roller 40 drivingly engages an inclined driving cam edge portion of a slot 115.

Referring now to FIGS. 14 to 22, a modified form of practice unit, according to the present invention, is designated generally at 201. The unit 201 has suitable walls 202 of netting or mesh material, or of any other suitable material, defining the practice enclosure, and is provided at one end with a cage portion 203 including a regulation-height net element 204 and a pneumatic device, shown generally at 208, which will collect balls with negative pressure through an intake conduit 251 and eject them over net element 204 with positive pressure through an injection conduit 230 at adjustable time intervals.

Figure 14:
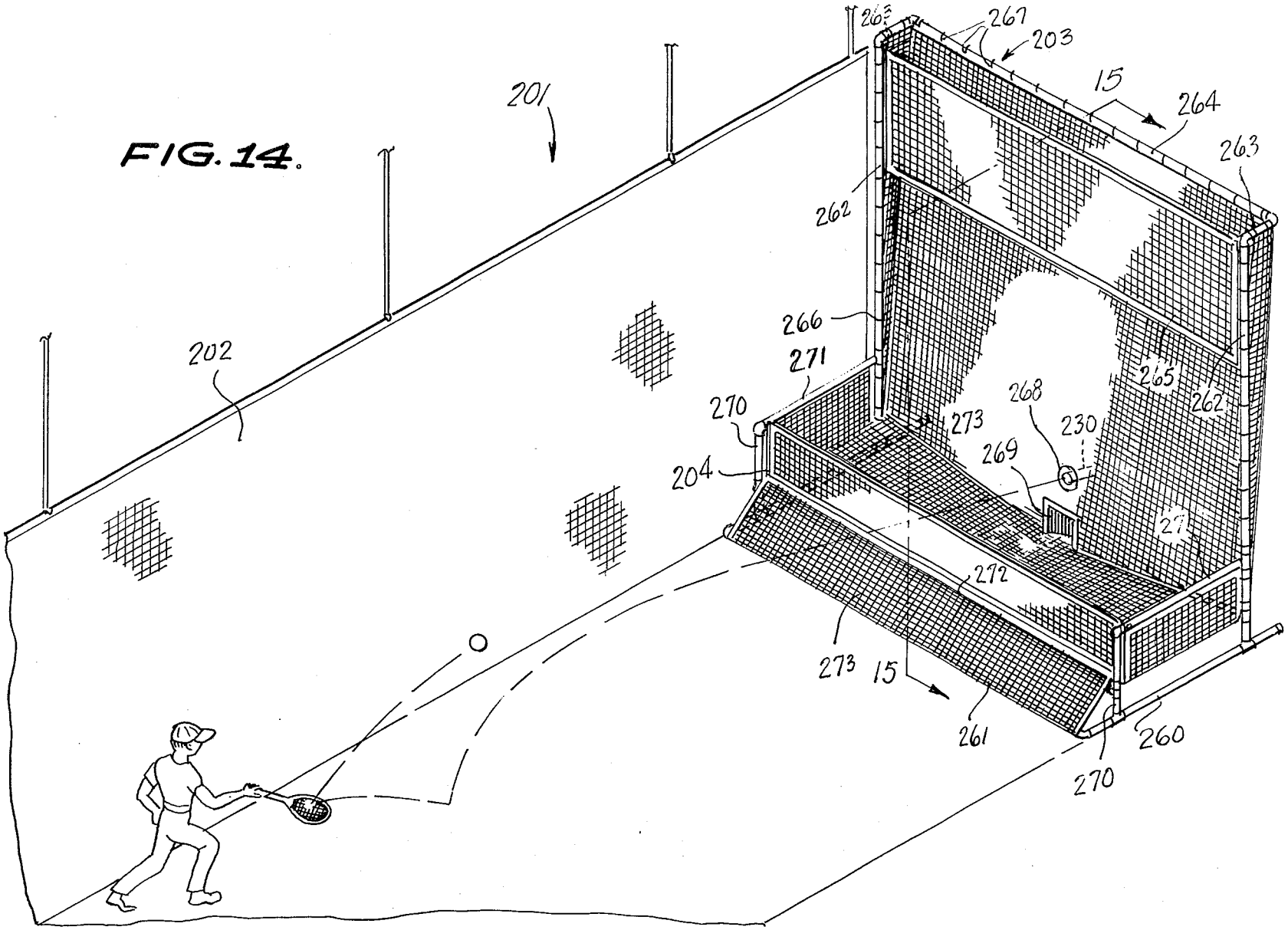
FIG. 14 is a perspective view, similar to FIG. 1, showing a modification of a typical tennis practice unit according to the present invention.
Figures 15, 22:
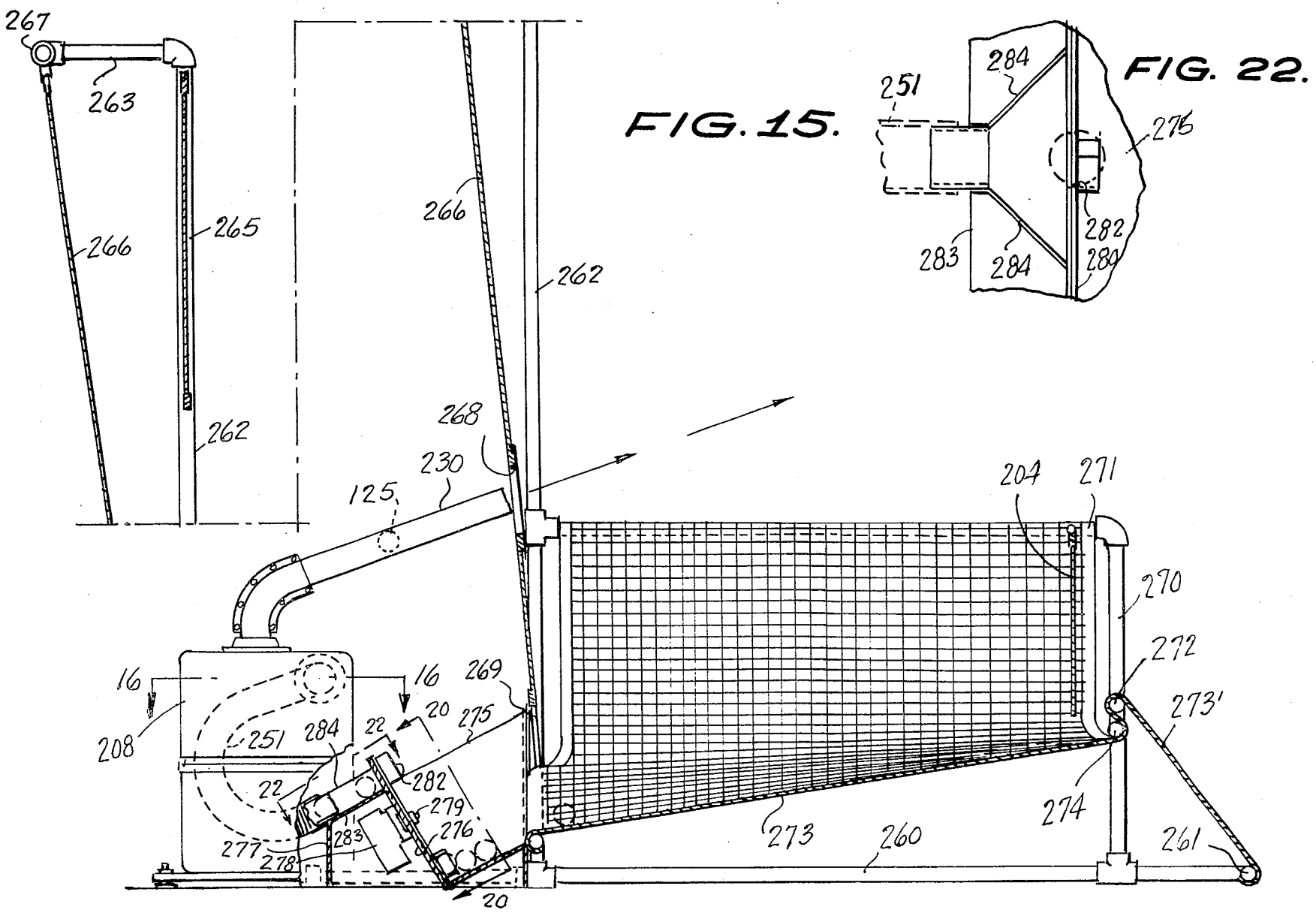
FIG. 15 is an enlarged vertical cross-sectional view taken substantially on line 15—15 of FIG. 14.
FIG. 22 is an enlarged detail view taken substantially on line 22—22 of FIG. 15.

Referring particularly to FIGS. 14 and 15, it will be seen that the cage portion 203 comprises a framework having opposite longitudinally extending horizontal bottom tubular bars 260,260 having their forward ends connected by a transversely extending horizontal bottom tubular bar 261. Rigidly secured to the rear portions of the side bars 260, 260 are respective upstanding vertical main supporting posts 262, 262 provided with relatively short rearwardly extending top arms 263, 263 which are rigidly connected by a horizontal transversely extending tubular bar 264. Swingably connected between the top corner bends defined by the posts 262 and arms 263 is a freely swingable depending generally rectangular screen member 265 which, in a typical embodiment of the invention, may have a height of about four and one-half feet, and which extends between the post arms 262, 262 and has, in said typical embodiment, a horizontal length of about fourteen feet four inches. The top corners of the screen member 265 are suitably connected in any manner permitting free swinging movement of the screen member to the elbow portions defined between post 262 and arms 263. A mesh backstop member 266 has a frame conformably shaped to be received in the enclosure defined by post elements 262, arms 263 and rear bar 264 and comprises open mesh-type netting suitable for outdoor use, which may be made of any suitable material including synthetic material such as nylon and other plastic material. As above mentioned, the screen assembly 266 has a marginal frame which may be made of any suitable rigid material and which is relatively loosely connected to the posts 262, or arms 263 and bar 264 by connecting ring elements 267 to enable the screen member 266 to move somewhat relative to the main supporting frame thereof under impact by tennis balls to provide an energy-absorbing effect. The freely suspended top screen member 265 likewise will provide an energy-absorbing effect when struck by tennis balls, because of its inertia. The swinging top screen member 265 likewise comprises a rigid rectangular outer frame and mesh material suitable for outdoor use, as in the case of the main backstop screen 266.

The screen member 266 is provided in its lower portion with an opening 268 registering with the discharge end of the ball-propulsion conduit 230, and is provided at the intermediate portion of its bottom margin with a ball-collection opening 269. Secured to the supporting bars 260 are upstanding forward first elements 270 to the top ends of which are connected longitudinally extending side frame members 271, 271 rigidly connected at their rear ends to the rear post members 262, 262. The net member 204 comprises mesh material, similar to that employed for the back-stop screen 266, supportingly secured in a rectangular frame which is swingably secured between the forward end portions of the bars 271, 271 with its vertical ends located inwardly adjacent to and spaced from the upper portions of the vertical post members 270, 270, as shown in FIG. 15. A transverse horizontal tubular bar member 272 is secured between the vertical post members 270, 270 forwardly adjacent the tennis net member 204. As shown in FIG. 15, another transversely extending horizontal tubular bar 274 is secured between the post members 270, 270 immediately below and parallel to the tubular bar 272. Mesh material 273 is secured to the bottom transverse tubular bar 261 at its outer margin and is engaged over bar 272 and beneath bar 274, as shown in FIG. 15, extending rearwardly and being inclined rearwardly and downwardly, as shown in FIG. 15. The mesh material is also inclined inwardly and downwardly from the respective sides of the enclosure defined between the side bars 271, 271. The mesh material 273 forming a collection enclosure is provided at its opposite side edges with means connecting to the side bars 271, 271 and is also suitably shaped so that it slopes downwardly and inwardly toward the ball-receiving opening 269, as shown in FIGS. 14 and 15.

It will thus be seen that balls impinging against either the main backstop screen 266 or the swingable top screen 265 will impinge on these elements, and will have their energy absorbed to a substantial degree by the resultant allowable movement of the screen elements. Furthermore, the mesh material will itself have some energy-absorbing characteristics, the total result being that the balls hitting the screen elements will tend to drop into the mesh enclosure provided behind the tennis net member 204 and the balls will then tend to roll down toward the collection opening 269.

As it will be seen from FIG. 15, the swingable tennis net member 204 is spaced inwardly sufficiently relative to the vertical plane of the post members 270, 270 to provide clearance for balls dropping downnwardly therefrom into the hopper-like enclosure provided rearwardly thereof. Bar member 272 is located slightly above the level of the bottom edge of the net member 204, as shown in FIG. 15. The purpose of the downwardly and forwardly inclined mesh portion 273' is to prevent balls from passing beneath the collection enclosure and also to cause balls impinging thereon to rebound and return toward the player.

As above described, the bottom surface of the collection enclosure, comprising the mesh member 273, has a compound shape which is inclined so that balls engaging thereon tend to roll downwardly and rearwardly toward the collection opening 269. As shown in FIGS. 14 and 15, the opposite side portions of the mesh member 273 are vertical to define mesh-like sidewalls and the member 273 slopes downwardly and inwardly from the two opposite side walls as well as downwardly and rearwardly from the transverse horizontal bottom wall 274.

As shown in FIG. 15, the ball-propulsion conduit 230 slopes upwardly and forwardly, for example, at an angle of approximately 20° with the horizontal (or 70°to the vertical) so that balls projected therefrom travel with a favorable trajectory similar to that which would be provided by an opposing player, whereby to generally simulate actual playing conditions.

Referring now to FIGS. 15, 20 and 21, it will be seen that a downwardly and rearwardly inclined channel-shaped chute member 275 is provided rearwardly and in registry with the collection opening 269, terminating at the upwardly and rearwardly inclined wall 276 of a motor housing 277. Mounted in the housing 277 is a motor unit 278 which includes conventional gear reducing means arranged to drive its output shaft 279 at the same rate of rotation as the ball-feeding cam disk 38 forming part of the pneumatic device 208. Axially secured to the shaft 279 adjacent to and parallel with the sloping wall 276 is a ball conveyor disk 280 formed with diametrically opposed ball-receiving openings 281, 281, the disk 280 being conformably received in the generally semi-cylindrical bottom portion of the channel-shaped chute 275, as shown in FIG. 20. The openings 281 are located to receive balls rolling down the rearwardly and downwardly inclined bottom wall of the chute member 275, and a cup-shaped generally semi-cylindrical flange 282 is provided at one side margin of each opening 281 to define a collection cup to receive a ball and lift the ball from the bottom portion to the top portion of the chute 275 responsive to the clockwise rotation of the disk member 280, as viewed in FIG. 20. The housing 277 is provided with a downwardly and rearwardly sloping top wall 283 and with spaced rearwardly converging upstanding walls 284, 284 leading toward and being connected to the inlet end of the ball-receiving conduit 251, as shown in FIG. 15.

As will be apparent from FIGS. 15, 20 and 21, the clockwise rotation of disk 280, as viewed in FIG. 20, causes a ball which has rolled to the bottom end of chute 275, to be picked up and elevated to a level above the housing top wall 283, at which time the ball escapes from its confining cup element 282 and rolls downwardly through the adjacent opening 281 into the chute defined between the rearwardly convergent walls 284, 284, allowing the ball to enter the intake end of the conduit 251. Thus, the elevating conveyor assembly defined by the disk 280, wall 276 and openings 281, 281 provides a means of sequentially feeding balls into conduit 251 in synchronization with the action of the ball-metering cam disk 38.

It will be seen from FIG. 21 that the shaft 279 is so located in the wall 276 that the upper portion of disk 280 projects sufficiently above top wall 283 to completely expose an opening 281 and allow a ball to roll therethrough on to wall 283.

As above mentioned, the simulated service net element 204 is swingably mounted between the forward end portions of the members 271, 271 and acts to cause balls impinging thereon to drop downwardly into the hopper-like ball collection enclosure. Thus, the impact of a ball on the net member 204 will cause it to swing rearwardly to absorb the momentum of the ball, in a manner similar to that provided by the top swingable mesh element 265. The member 204 may be suitably weighted to limit the rearward swinging action thereof. The hinge connection of member 204 to the bars 271 may be of any suitable construction, for example, may comprise a steel cable secured to the top edge of the net member 204 with its ends engaged through and connected to the forward end portions of the horizontal side bar members 271, 271. The hinge connection for the top swingable net member 265 to the post members 262, 262 may comprise a similar construction.

Figure 16:
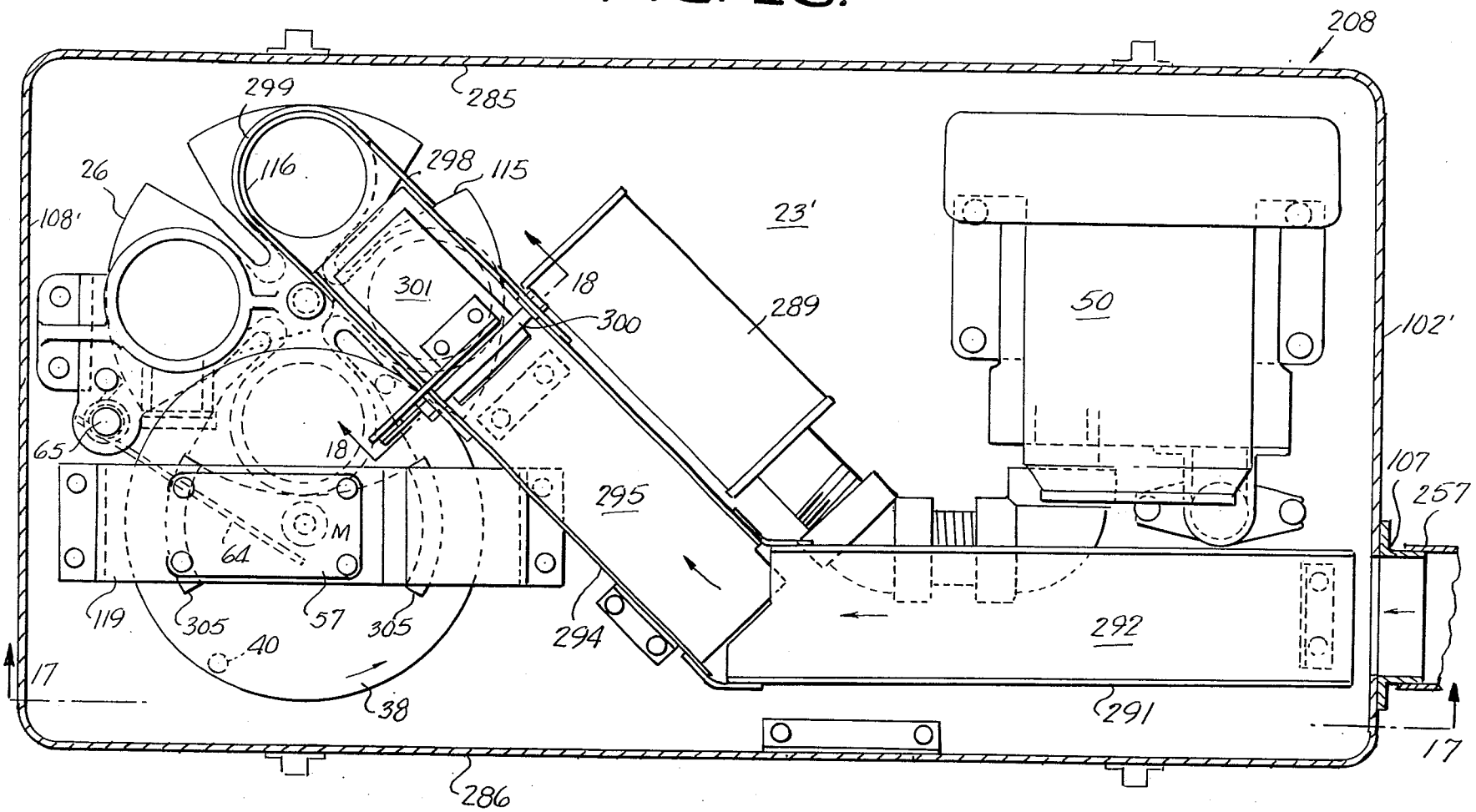
FIG. 16 is an enlarged horizontal cross-sectional view taken substantially on line 16—16 of FIG. 15.
Figure 17:
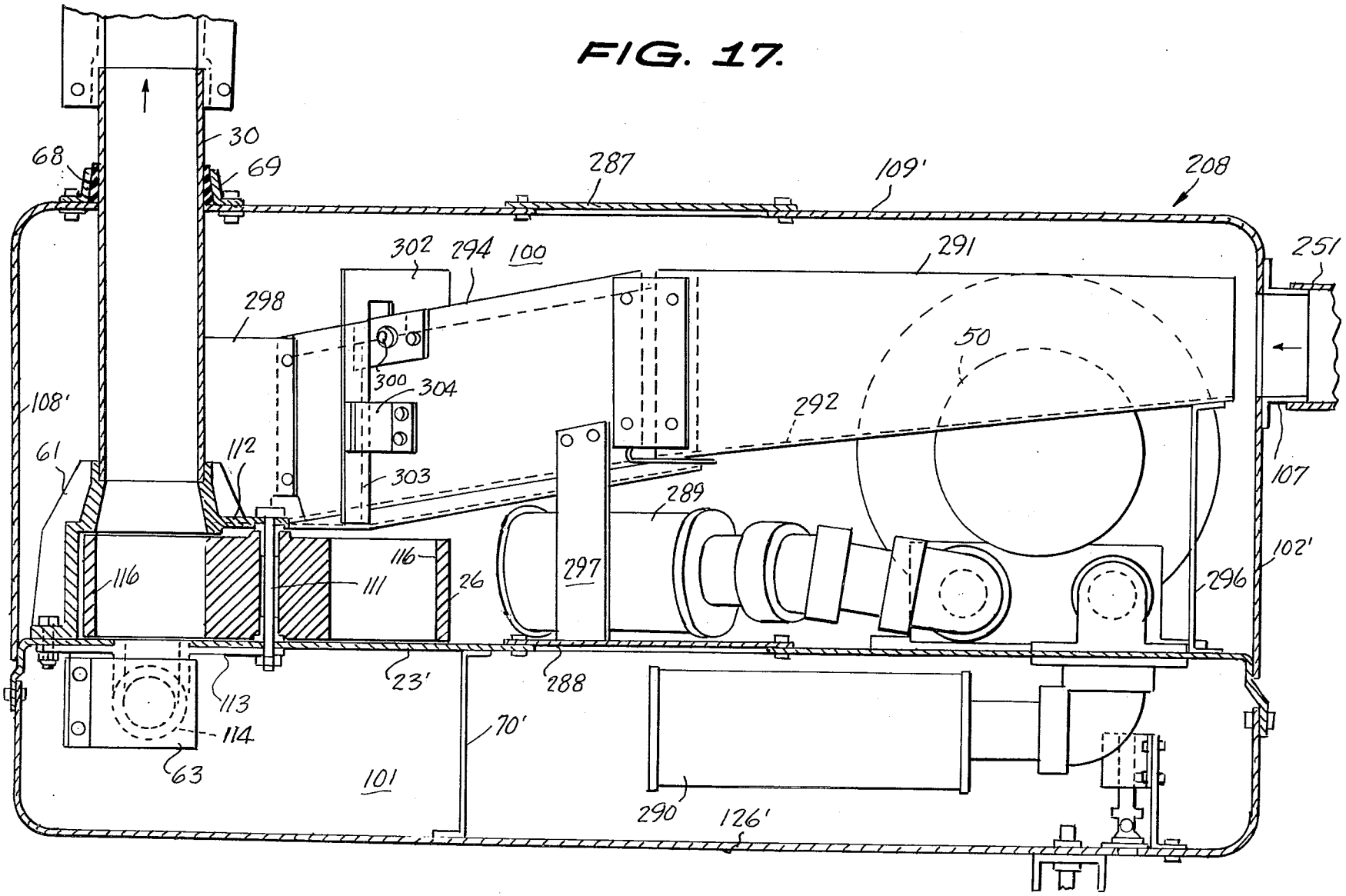
FIG. 17 is a vertical cross-sectional view taken substantially on line 17—17 of FIG. 16.
Figure 23:
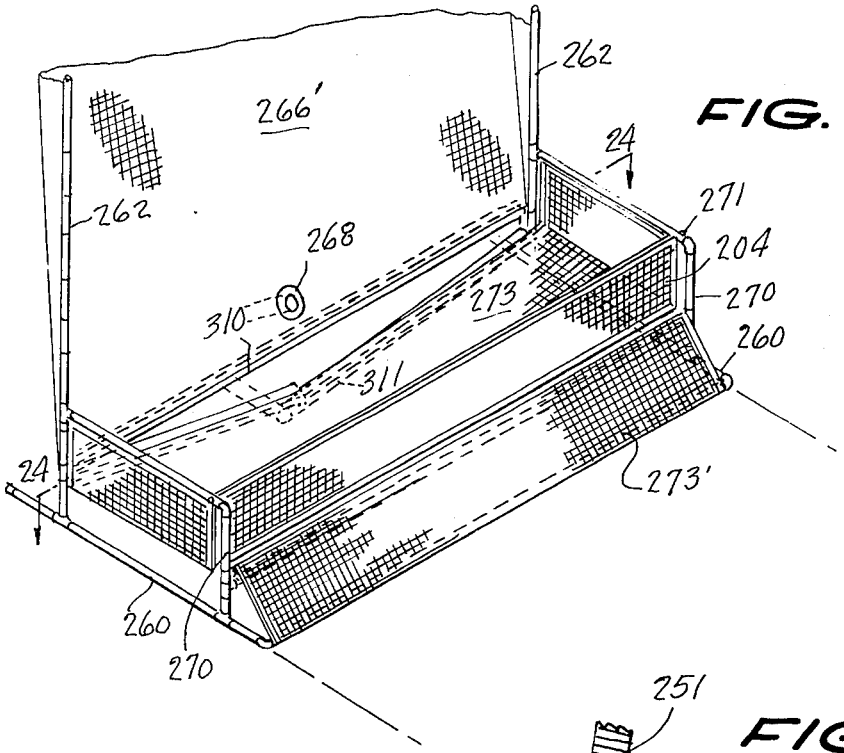
FIG. 23 is a perspective view of the ball retrieval enclosure and adjacent parts of another form of tennis practice unit according to the present invention.
Figure 24:
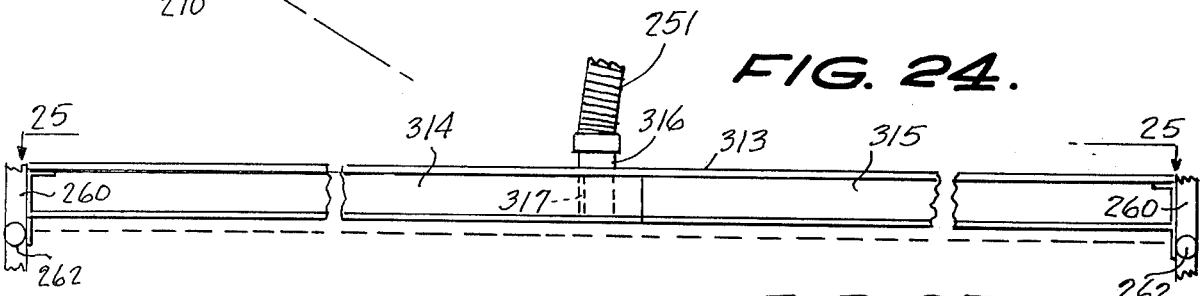
FIG. 24 is a fragmentary enlarged horizontal cross-sectional view taken substantially on line 24—24 of FIG. 23.
Figure 25:
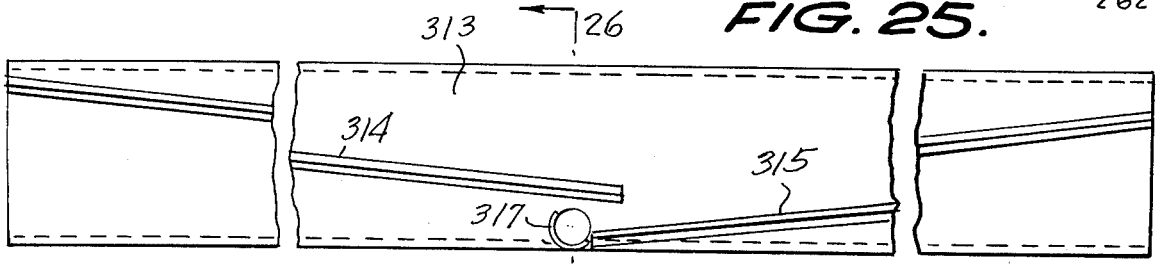
FIG. 25 is a vertical cross-sectional view taken substantially on line 25—25 of FIG. 24.

Referring now to FIGS. 16 and 17, it will be seen that the device 208 comprises a main housing similar to that employed in the previously described embodiment of the invention having a top wall 109', a bottom wall 126' and opposite end walls 102' and 108', which together with respective side walls 285 and 286 define a rectangular enclosure. This housing is provided with the intermediate horizontal deck 23' defining the bottom positive pressure space 101 and the upper negative pressure space 100, as in the previously described form of the invention. The horizontal deck 23' is supportingly secured to the bottom wall 126' by Z-shaped brackets 70' instead of the posts 70 in the previously described form of the invention. Top wall 109' and deck 23' are provided with removable access cover plates, shown respectively at 287 and 288.

The blower assembly 50 is provided with an intake muffler 289 located in the negative pressure space 100 and with an exhaust muffler 290 located in the positive pressure space 101, as shown in FIG. 17. The mufflers 289 and 290 are provided in order to reduce blower noise. Said mufflers are of generally conventional construction.

As shown in FIG. 17, the ball supply conduit 251 is connected to the ball-conveying fitting 107 located at the upper portion of wall 102'. This fitting registers with a channel-shaped ball chute 291 which has a downwardly and leftwardly inclined bottom wall 292, as viewed in FIG. 17. Chute 291 extends longitudinally and is connected to a second chute member 294 at an angle of approximately 135 degrees, the chute 294 likewise having a downwardly and leftwardly inclined bottom wall 295. As shown in FIG. 17, the chutes 291 and 294 are suitably supported on the deck 23', for example, by vertical bracket members 296 and 297. The chute 295 is provided with an end ball-receiving enclosure 298 having a semi-cylindrical end portion 299 which is vertically axially aligned with one of the vertical conduit elements 116 of turret member 26 in its ball-propulsion position, as shown in FIG. 16.

As shown in FIGS. 18 and 19, a horizontal shaft member 300 is journaled in the upper portion of the chute 294 at a location thereon providing a space for two balls in the leftward end portion of the chute assembly, namely, in that portion of the chute assembly located above the turret member 26. Secured on the shaft 300 is a depending ball gate member 301 which has a top arm 302 provided with an external vertically depending cam follower arm 303 which normally engages against a stop flange 304 secured to the adjacent side wall of chute 294. The bottom end of the follower arm 303 is engageable by respective diametrically opposite camming projections 305, 305 provided on the circular cam disk 38. Thus, a projection 305 cammingly engages the lower end of the arm 303 to swing gate 301 in a counterclockwise direction, as viewed in FIG 19, to its open position simultaneously with the movement of a chamber 116 into ball-propulsion position, to thereby feed another ball into the space over turret member 26 as a ball is propelled from the machine. The projections 305 are arcuately shaped and are concentric with the disk 38 and are of sufficient length to open the gate member 301 and allow a ball to pass rightwardly therethrough, as viewed in FIG. 19, as disk member 38 rotates so as to move turret member 26 into ball-propulsion position.

As previously mentioned, the movement of disk 38 is synchronized with the movement of disk member 280 so as to steadily feed balls one-by-one into conduit 251 at the same rate as they are being propelled from the outlet conduit 230.

As a ball is passed under gate 301, the associated cam projection 305 disengages from the bottom end of the arm 303, allowing the gate 301 to swing towards lowered position by gravity, in which position arm 303 engages against the stop lug 304, as shown in dotted view in FIG 19.

The provision of the automatically-operated gate member 301 insures smooth feeding action of the tennis balls and insures against jamming of said balls as they travel through the apparatus. Likewise, it will be seen that each time the turret member 26 rotates into ball-propulsion position, a ball is available in the chute 294 in the end portion thereof immediately adjacent to the gate 301, which ball can then drop into the space 116 and be propelled therefrom in the manner described in connection with the previously disclosed form of the invention. At the same time, the gate 301 is swung to its open position by the action of the associated cam projection 305, above described, to allow entry of the next ball into a position to make it available for reception by the next ball-conveying conduit portion 116.

As it will be readily apparent, the modified form of the invention, illustrated in FIGS. 14 to 22, may be provided with ball-detecting scoring means similar to that described in connection with the first-disclosed form of the invention, including suitable sequence-responsive circuitry operating to close the scoring circuit only when a detector for the horizontal zones has its beam interrupted before a detector for the vertical zone responds to interrupt the associated light beam. Similarly, conventional coin-controlled timing circuitry may be provided to control the energization of the operating motors of the device, to thereby limit a player's use of the practice device for a time period corresponding to the value of a coin dropped into the coin controlled mechanism, or alternatively, any other suitable visible timing device may be employed to measure the amount of time that the apparatus is used by a player.

It will be noted that in the arrangement illustrated in FIGS. 18 and 19, the gate member 301 is normally in an inclined position such that there is not sufficient clearance for a ball 125 to roll therepast downwardly along bottom wall 295. As a cam element 305 engages the bottom end of the follower member 303, arm 303 is swung in a counterclockwise direction, as viewed in FIG. 19, raising the gate member 301 sufficiently to allow the ball 125 to roll thereunder. After the projection 305 moves past the bottom end of the follower member 303, the member 303 swings back by gravity into engagement with the stop lug 304 and resumes its normal vertical position, returning the gate member 301 to its normal inclined position shown in full line view in FIG. 19, wherein the next ball will be held stationary until the succeeding projection 305 again swings arm 303 counterclockwise towards its release position.

Figure 26:
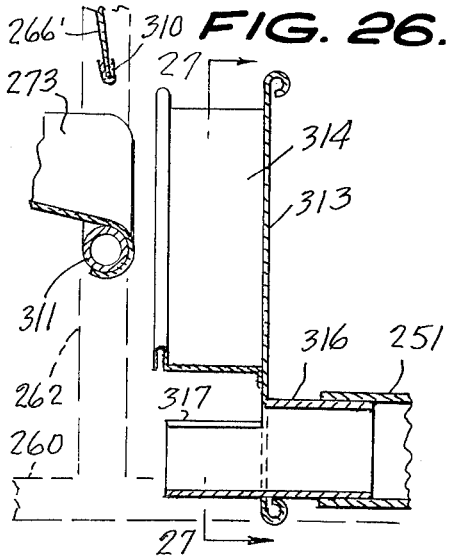
FIG. 26 is an enlarged vertical cross-sectional view taken substantially on line 26—26 of FIG. 25.
Figure 27:
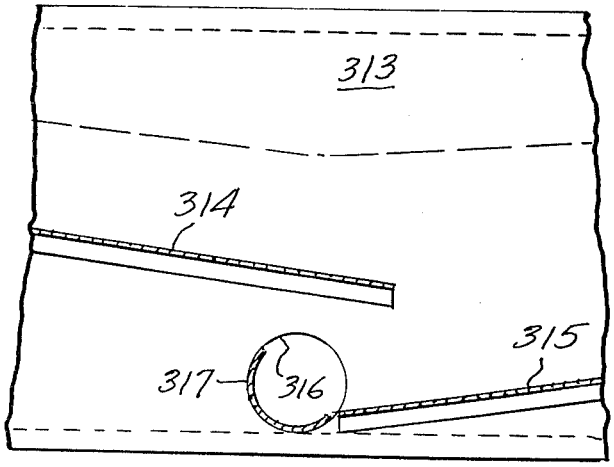
FIG. 27 is a vertical cross-sectional view taken substantially on line 27—27 of FIG. 26.

FIGS. 23 to 27 illustrate a further improved embodiment of a tennis practice unit according to the present invention wherein the main backstop screen, shown at 266', has a horizontal bottom edge 310 comprising a suitable rigid stiffening bar element, as shown in FIG. 26. The ball-collection hopper net portion 273 has its rear margin tightly engaged over and secured to a transversely extending rigid supporting pipe element 311 rigidly secured at its opposite ends to the lower portions of the post members 262, 262, said tubular member 311 being generally V-shaped. As shown in FIG. 26, there is thus defined a space beneath the member 311 and the bottom plane of tubular frame members 260, 260. Rigidly secured between the rear end portions of the tubular frame bars 260, 260 rearwardly adjacent to the tubular bar element 311 is a transversely extending vertical plate member 313 which rises to a height somewhat above that of the V-shaped bar member 311, as shown in FIG. 26. Rigidly secured to the plate member 313 on the side thereof adjacent the margin of the hopper net member 273 are a pair of downwardly and inwardly inclined ramp members 314 and 315. Secured in the bottom midportion of the plate member 313 is a ball-retriever conduit 316 having a forwardly extending portion 317 of generally semi-cylindrical shape and defining a ball-receiving trough. As shown in FIG. 27, the ramp member 314 extends over and terminates slightly beyond the trough 317, whereas the opposite ramp 315 terminates adjacent the bottom edge of the trough member 317, being spaced below the end portion of the ramp member 314 sufficiently to allow a ball rolling down ramp member 314 to drop onto ramp member 315 and to roll therefrom into the trough member 317, as will be readily apparent from FIG. 27. As will be seen from FIG. 27, the top plane of the edges of trough member 317 is inclined somewhat so that the trough member 317 substantially faces the ramp member 315 in a manner to readily receive balls rolling down ramp member 315. This arrangement provides a highly efficient means for preventing jamming of balls traveling toward the ball-retrieval conduit 316.

The negative pressure inlet conduit 251 is connected to the ball-retrieval conduit 316 in the manner illustrated in FIG. 26, whereby to convey balls directly from conduit 316 to the pneumatic device 208.

As will be apparent from FIGS. 23 to 27, balls striking the main backstop net 266', or other balls falling into the hopper enclosure, will travel downwardly and roll over the rear edge of the hopper of screen 273 and drop into the ramp member 314 or 315, traveling downwardly thereon and eventually reaching the trough 317 and passing therethrough into the ball-retrieval conduit 316 to be thence drawn through the pneumatic device 208 in the manner previously described. The ramp arrangement shown in FIGS. 24 to 27 acts as a highly efficient anti-jamming arrangement and insures steady progression of the balls retrieved into the pneumatic device 208. This arrangement is somewhat simpler than the arrangement shown in FIGS. 15 and 20 to 22, and above described, although the arrangement of FIGS. 15 and 20 to 22 presents certain advantages in that the downwardly and rearwardly inclined channel-shaped chute member 275 provides a storage space for collecting and retaining a reserve supply of tennis balls, to thus assure continued feeding of tennis balls to the device 208 over a wide range of playing conditions.

While certain specific embodiments of an improved game practice device and a ball-collection and throwing apparatus therefor have been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A game practice device comprising a playing area provided with a transverse barrier and a ball recovery and throwing assembly behind said barrier, said assembly comprising:

a. a backstop screen member having an impact portion extending upwardly relative to said barrier and a ball-receiving portion extending subjacent said barrier; and b. a pneumatic ball thrower having a ball intake conduit in communication with said ball-receiving portion and a ball-propulsion conduit arranged to convey balls through said screen member and propel them forwardly over the barrier, said ball thrower further comprising:

i. a negative pressure compartment connected to said ball intake conduit;

ii. a positive pressure compartment;

iii. means located in said negative pressure compartment for feeding balls in a regularly timed sequence to said propulsion conduit;

iv. normally closed value means between said positive pressure compartment and said ball feeding means;

v. means to intermittently apply positive pressure to balls fed into said propulsion conduit substantially in synchronism with the feeding of the balls to said propulsion conduit, comprising means to open said valve means when a ball has been fed to said propulsion conduit.

2. The game practice device of claim 8, and wherein said ball feeding means comprises a rotary member having ball-receiving conduit portions located to be at times aligned with said propulsion conduit, and means to give balls from said intake conduit to said ball-receiving conduit portions.

3. The game practice device of claim 2, and wherein the means to feed the balls in said regularly timed sequence comprises intermittently-operated drive means acting on said rotary member.

4. The game practice device of claim 3, and wherein said drive means comprises a continuously driven rotary drive element and interengaging cam means on said rotary drive element and said rotary member constructed to rotate said rotary member in successive timed steps, each step being of sufficient magnitude to place a ball-receiving conduit portion in alignment with said propulsion conduit.

5. The game practice device of claim 4 and wherein the means to open said valve means comprises a projection on said rotary drive element operatively engageable with said valve means during each of said timed steps.

6. The game practice device of claim 5, and wherein said interengaging cam means comprises said projection and means on the rotary member defining drive slots located to receive said projection and shaped to rotate said rotary member through a step responsive to rotation of said rotary drive element.

7. The game practice device of claim 6, and wherein the means to guide balls from the intake conduit to the ball-receiving conduit portions comprises a ramp element mounted in said negative pressure compartment between said intake conduit and said ball-receiving conduit portions and inclined downwardly toward said ball-receiving conduit portions.

8. The game practice device of claim 7, and wherein said ball thrower includes a blower assembly having an intake port connected to said negative pressure compartment and an outlet conduit connected to said positive pressure compartment.

9. The game practice device of claim 8, and wherein said positive pressure compartment is provided with adjustable vent valve means for adjusting the effective pressure in said positive pressure compartment and thereby adjusting the propulsion velocity of balls discharged from said ball propulsion conduit.

10. A game practice device comprising a playing area provided with a transverse barrier and a ball recovery and throwing assembly behind said barrier, said assembly comprising a backstop screen member having an impact portion extending upwardly relative to said barrier and a ball-receiving portion extending subjacent said barrier, and a pneumatic ball thrower having a ball intake conduit in communication with said ball-receiving portion and a ball-propulsion conduit arranged to convey balls through said screen member and propel them forwardly over the barrier, wherein said ball thrower is provided with means to feed balls inn a regularly timed sequence to said propulsion conduit, wherein said ball feeding means comprises a rotary member having ball-receiving conduit portions located to be at times aligned with said propulsion conduit, and means to guide balls from said intake conduit to said ball-receiving conduit portions, and wherein said ball-guiding means includes normally closed ball gate means and means to open said gate means when a conduit portion becomes aligned with said propulsion conduit.

11. The game practice device of claim 10, and wherein said ball-guiding means comprises inclined chute means between said ball intake conduit and said rotary member.

12. The game practice device of claim 11, and wherein said gate means is pivotally mounted in said inclined chute means.

13. The game practice device of claim 10, and wherein the means to feed the balls in said regularly timed sequence comprises intermittently-operated drive means acting on said rotary member, and interengaging cam and follower means on said drive means and gate means formed to open the gate means when a conduit portion becomes aligned with said propulsion conduit.

14. A game practice device comprising a playing area provided with a transverse barrier and a ball recovery and throwing assembly behind said barrier, said assembly comprising a backstop screen member having an impact portion extending upwardly relative to said barrier and a ball-receiving portion extending sbjacent said barrier, and a pneumatic ball thrower having a ball intake conduit in communication with said ball-receiving portion and a ball-propulsion conduit arranged to convey balls through said screen member and propel them forwardly over the barrier, and a photoelectric sensing array above the barrier responsive to returned balls passing over the barrier and arranged to indicate the zonal location of said returned balls.

15. A game practice device comprising a playing area provided with a transverse barrier and a ball recovery and throwing assembly behind said barrier, said assembly comprising a backstop screen member having an impact portion extending upwardly relative to said barrier and a ball-receiving portion extending subjacent said barrier, and a pneumatic ball thrower having a ball intake conduit in communication with said ball-receiving portion and a ball-propulsion conduit arranged to convey balls through said screen member and propel them forwardly over the barrier, and wherein said screen member comprises a yieldable upper forwardly convex portion and a lower upwardly concave portion connected at its lowermost region to said ball intake conduit.

16. A ball collection and throwing apparatus comprising a housing, partition means in said housing defining a ball-receiving space and a second space, means for placing said second space at positive pressure, ball inlet means connected to said ball-receiving space, ball outlet conduit means connected to the housing and extending into said ball-receiving space, said partition means having an aperture aligned with said ball outlet conduit means, a rotary ball feed member in said ball-receiving space between said partition means and said outlet conduit means, said feed member having a plurality of ball-receiving conduit portions spaced equally around its axis of rotation and located to receive balls admitted through said inlet means, said axis being located so that each conduit portion is at times rotatable to a position between and registering with said outlet conduit means and aperture means to intermittently rotate the feed member to such positions, means to communicatively connect the positive pressure space through said aperture to a conduit portion when the conduit portion is placed in registry with the outlet conduit means, and means to place the ball-receiving space at negative pressure.

17. The ball collection and throwing apparatus of claim 16, and wherein the means to communicatively connect the positive pressure space to a conduit portion comprises normally closed valve means between the aperture and the positive pressure space, and means to open said valve means when said conduit portion has been placed in registry with the outlet conduit means.

18. The ball collection and throwing apparatus of claim 17, and wherein the means to intermittently rotate the feed member comprises a continuously rotating drive member mounted in said housing, and interengaging cam means on the drive member and feed member periodically rotating the feed member through rotational steps sufficient to place successive conduit portions in registry with said outlet conduit means.

19. The ball collection and throwing apparatus of claim 18, and wherein said cam means comprises a projection on said continuously rotating drive member and means on the feed member defining a plurality of cam slots arranged to receive said projection and to rotate the feed member through a step each time the projection engages in a slot, with a dwell period between said rotational steps.

20. The ball collection and throwing apparatus of claim 19, and wherein the means to open said valve means comprises an operating arm on the valve means engageable by said projection during the dwell period following a rotational step.

21. The ball collection and throwing apparatus of claim 20, and wherein the means placing the two spaces respectively at negative and positive pressures comprise a blower assembly mounted in the housing and having an air intake port exposed to said ball-receiving space and an air outlet conduit connected to said positive pressure space.

22. The ball collection and throwing apparatus of claim 20, and wherein the positive pressure space is provided with adjustable vent valve means for controlling the effective pressure in the positive pressure space.

23. The ball collection and throwing apparatus of claim 20, and inclined ramp means in the ball-receiving space arranged between the ball inlet means and the feed member and shaped to guide balls toward the ball-receiving conduit portions of the feed member.

24. The ball collection and throwing apparatus of claim 16, and means for varying the rate of the intermittent rotation of the feed member, whereby to vary the rate of discharge of balls through said ball outlet conduit means.

25. The ball collection and throwing apparatus of claim 24, and wherein said means to intermittently rotate the feed member is provided with an adjustable-speed driving motor for varying the rate of the intermittent rotation of the feed member.

26. A game practice device comprising a playing area provided with a transverse barrier and a ball recovery and throwing assembly behind said barrier, said assembly comprising a backstop screen structure having an impact portion extending upwardly relative to said barrier and a ball-receiving portion extending subjacent said barrier, and a pneumatic ball thrower having a ball intake conduit in communication with said ball-receiving portion and a ball propulsion conduit arranged to convey balls through said backstop screen structure and propel them forwardly over the barrier, said ball thrower being provided with means to feed balls in a regularly timed sequence to said propulsion conduit, elevating conveyor means between said ball-receiving portion and said ball intake conduit, for delivering balls from said receiving portion to said intake conduit, said elevator conveyor means operating at the same ball feeding rate as said ball feeding means, said ball receiving portion being provided with an inclined ball exit chute, said elevating conveyor means having ball-receiving elevating cup elements arranged to sequentially register with said exit chute and said ball intake conduit and being formed to carry balls from said exit chute to said ball intake conduit.

27. The game practice device of claim 26, and wherein said ball-propulsion conduit is inclined upwardly and forwardly.

28. The game practice device of claim 27, and wherein said ball-propulsion conduit is inclined upwardly and forwardly at an angle of approximately 20 degrees to the horizontal.

29. A tennis practice device comprising:

a. pneumatic means for projecting tennis balls toward a player;

b. pneumatic means for collecting said tennis balls after being struck by said player and feeding them to said means for projecting;

c. tennis net disposed forward adjacent to said projecting and collecting means;

d. said collecting means including a ball-collecting receptacle behind the net and an upstanding screen assembly upwardly adjacent the receptacle;

e. said receptacle being provided with a bottom wall sloping toward a rear edge portion thereof;

f. inclined ramp means subjacent the rear edge of said bottom wall and leading toward said pneumatic collecting means, said ramp means being arranged to receive balls rolling past said rear edge of said receptacle bottom wall and comprising a pair of transversely extending downwardly and inwardly inclined guide ramps subjacent said bottom wall rear edge, the inner edge of one guide ramp extending over the inner end of the other ramp and being spaced therefrom sufficiently to allow a ball rolling off the inner end of said one ramp to engage on the other ramp and continue to roll downwardly on said other ramp, and ball-receiving conduit means at the bottom end of said other ramp, said conduit means being communicatively connected to said pneumatic means, and including a channel-shaped ball-receiving portion substantially facing said other ramp.

30. A game practice device comprising a playing area provided with a transverse barrier and a ball recovery and throwing assembly behind said barrier, said assembly comprising a backstop screen member having an impact position extending upwardly relative to said barrier and a ball-receiving portion extending subjacent said barrier, a pneumatic ball thrower having a ball intake conduit in communication with said ball-receiving portion and a ball-propulsion conduit arranged to propel balls forwardly over the barrier, a ball storage means having individual ball storage compartments for discretely temporarily storing a plurality of said balls, mens for receiving balls from said intake conduit and automatically feeding said balls to said storing means, and means for automatically bringing each of said storage compartments into registry with said ball-propulsion conduit in a predetermined timed sequence, said ball thrower including means to generate negative pneumatic pressure in said intake conduit and positive pneumatic pressure in said propulsion conduit and means for automatically intermittently applying said positive pneumatic pressure to said propulstion conduit in substantial synchronism with the registry of one of said ball containing storage compartments with said propulsion conduit.

31. The game practice device of claim 30 wherein said means for generating positive pneumatic pressure is continuously operating and further including means for storing said positive pneumatic pressure in said ball thrower for application to said propulsion conduit.

32. The game practice device of claim 30 further including elevating conveyor means between said ball-receiving portion and said ball intake conduit, for delivering balls from said receiving portion to said intake conduit in accordance with said timed sequence.

33. The game practice device of claim 32 wherein said elevator conveyor means comprises means for individually and seperately holding said balls prior to delivery to said intake conduit.

34. The game practice device of claim 33 wherein said holding means comprises at least one substantially cup-shaped element.

* * * * *